US005972577A

United States Patent [19]

Komatsu et al.

[11] Patent Number: 5,972,577

[45] Date of Patent: Oct. 26, 1999

[54] PROCESSING METHOD OF SILVER HALIDE PHOTOGRAPHIC LIGHT-SENSITIVE MATERIAL

[75] Inventors: Hideki Komatsu; Masayuki Kurematsu; Kazuhiko Hirabayashi, all of Hino, Japan

[73] Assignee: Konica Corporation, Tokyo, Japan

[21] Appl. No.: 09/028,892

[22] Filed: Feb. 24, 1998

[30] Foreign Application Priority Data

Feb. 25, 1997 [JP] Japan ..... 9-040658
Feb. 28, 1997 [JP] Japan ..... 9-045210

[51] Int. Cl.[6] ..... G03C 5/38

[52] U.S. Cl. ..... 430/401; 430/455

[58] Field of Search ..... 430/401, 455

[56] References Cited

U.S. PATENT DOCUMENTS 3,242,843 3/1966 Tillotson et al. ..... 396/620
5,221,597 6/1993 Fujita et al. ..... 430/455

FOREIGN PATENT DOCUMENTS 0 410 322 A2 1/1991 European Pat. Off. .
1 001 588 1/1957 Germany .
364414 10/1992 Switzerland .
698080 10/1953 United Kingdom .

*Primary Examiner*—Hoa Van Le
*Attorney, Agent, or Firm*—Frishauf, Holtz, Goodman, Langer & Chick, P.C.

[57] ABSTRACT

A processing method using an automatic processor is disclosed. The automatic processor is defined in the specification in detail. The processing is carried out employing a fixer having a salt concentration of 0.8 to 1.9 mole/l at a fixer replenisher rate of not more than 260 ml/m$^2$.

8 Claims, 4 Drawing Sheets

PROCESSING METHOD OF SILVER HALIDE PHOTOGRAPHIC LIGHT-SENSITIVE MATERIAL

FIELD OF THE INVENTION

The present invention relates to a processing method of a silver halide photographic light-sensitive material.

BACKGROUND OF THE INVENTION

A silver halide photographic light-sensitive material (hereinafter referred to as a "light-sensitive material") employed for printing and plate-making applications is generally exposed and then processed employing an automatic processor comprising at least a development section, a fix section, a water wash section or stabilizing bath section and a drying section, while generally replenishing the original processing solution. In recent years, environmental protection has been a major concern and a decrease in photographic solution wastes has been demanded. One means to meet the requirements is a decrease in the replenisher amount of processing solutions.

A decrease in the replenisher amount of processing solution has been gradually realized by a component replenishing technique in which the replenisher amount is decreased and photographic performance is stabilized, and a technique in which a silver-solubilizing agent and silver-dissolving-out preventing agent are incorporated in order to prevent the formation of silver stain on film and an automatic processor caused by the increase in the concentration of dissolved-out silver.

Furthermore, when contrast-increasing agents (tetrazine, tetrazolium compounds) in a light-sensitive material are dissolved out to a processing solution, the consistency in sensitivity is degraded during a continuous processing and sludges are liable to be formed. Therefore, practices have been made so that these are immobilized in the light-sensitive material. On the other hand, these which are hardly dissolved out into a processing solution are brought into a drying step to cause frequently stain on rollers. Hence, the development for the contrast-increasing agents or contrast-increasing methods has been required which neither deteriorates photographic performances nor stains the automatic processor.

SUMMARY OF THE INVENTION

Particularly with the decrease in the replenisher amount of a fixer, there have been found no technique to improve effectively a trouble of stain caused by the increase in the concentration of materials dissolved out from a light-sensitive material to the fixer and the increase in residence time of the fixer.

An object of the present invention is to provide a processing method of a silver halide photographic light-sensitive material which causes no adverse staining even with a decrease in the fixer replenisher rate.

The present invention is also to provide a processing method of a contrast-increased high silver halide photographic light-sensitive material enabling the decrease in the supply amount and solution wastes of a processing solution, no formation of staining on rollers and the decrease in the amount of wash water.

The present invention and its embodiment are described.

A processing method of a silver halide photographic light-sensitive material in which an automatic processor is employed which is constituted in such a manner that a section is provided which conveys the silver halide photographic light-sensitive material in vertical direction; a plurality of arranged rollers are provided so as to be in contact with or adjacent to the above-mentioned silver halide photographic light-sensitive material; a structure is provided that by employing a roller having a processing solution-containing function and/or providing a solution-collecting vessel, at a lower position of the roller, into which a part of the roller is immersed, the processing solution is supplied by the rotation of rollers to the silver halide photographic light-sensitive material; there is provided at least one selected from the means to supply the processing solution to the roller at the upper position, the solution-collecting vessel and the silver halide photographic light-sensitive material, and the supplied processing solution is supplied to the roller at the lower position and/or the solution-collecting vessel through gravity flow and/or overflow, and processing is carried out employing a fixer having a salt concentration of 0.8 to 1.9 mole/l at a fixer replenisher rate of not more than 260 ml/m$^2$.

In the processing method of a silver halide photographic light-sensitive material the processing is carried out employing a fixer comprising at least one compound selected from polyalkylene oxides, compounds represented by the formula (1) and compounds represented by the formula (2) at a fixer replenisher rate of 260 ml/m$^2$,

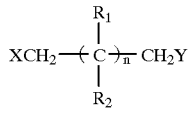

(1)

wherein X and Y each independently represents a halogen atom, a hydroxyl group, a sulfonic acid group, a carboxyl group, and $R_1$ and $R_2$ each independently represents a hydrogen atom or a hydroxyl group and n represents an integer of 3 to 10, $$CH_3(CH_2)_n—(O)_m—SO_3M \quad (2)$$

wherein n represents an integer of 4 to 15; m represents 0 or 1 and M represents an alkali metal.

The fixer preferably comprises at least one compound selected from tartaric acids or gluconic acids and/or comprises no boric acids, and the total processing time is not longer than 50 seconds, and a light-sensitive material to be processed comprises at least one compound selected from hydrazine derivatives or quaternary onium salt compounds.

In the processing method of a silver halide photographic light-sensitive material, the silver halide photographic light-sensitive material comprises a hydrazine derivative in the emulsion layer or another hydrophilic colloid layer.

In the processing method of a silver halide photographic light-sensitive material, the silver halide photographic light-sensitive material comprises a tetrazolium compound in the emulsion layer or another hydrophilic colloid layer.

REFERENCE NUMERALS

Figure 1:
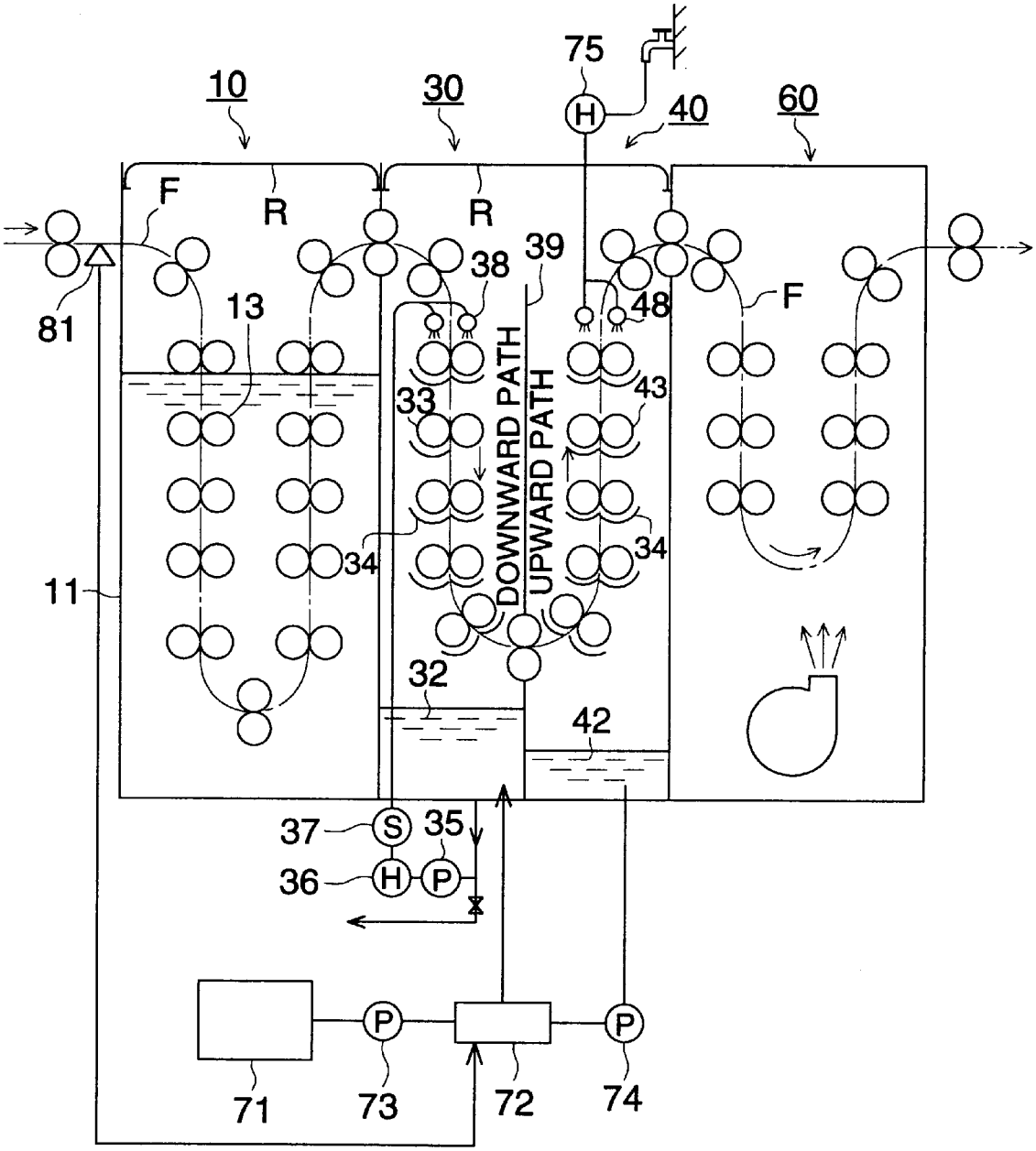
FIG. 1 shows a schematic structure of the automatic processor according to the present invention.

10 Developing section
11 Developer tank
13 Pair of transporting roller
30 Fixing section
32 Fixer-collecting section
33, 43 Paired conveyance rollers having solution-collecting vessel
34 Solution-collecting vessel
34A Overflow
34C Pipe
35 Pump
36 and 75 Heater
37 Temperature sensor
38 Nozzle at upper position
39 Partition board
40 Water washing step
42 Wash water collecting section
60 Drying step
71 Fixer replenisher tank
72 Replenisher control device
73 and 74 Pump
75 Heater
81 Sensor
91 Fresh solution supply vessel for fixer or bleach-fixer replenisher
98 Nozzle from supply vessel
95 Stabilizer supply vessel
F Light-sensitive material (film)

DETAILED DISCLOSURE OF THE INVENTION

In the following, each item of the present invention is explained in detail.

(Automatic Processor)

The automatic processor according to the present invention is described below. The automatic processor is particularly such that described in U.S. Pat. No. 5,669,035.

A specific constitution is shown below in which a plurality of rollers are arranged in vertical direction so as to be in contact with a silver halide photographic light-sensitive material.

A constitution is that paired rollers putting a light-sensitive material between them are arranged in vertical direction or rollers are arranged in vertical direction employing a structure in which the roller and a guiding member having at least a flat one side put a light-sensitive-material between them. The rollers may be arranged horizontally or in zigzag.

Furthermore, the constitution of the roller having a processing solution-containing function is such a state that processing solution is constantly adhered or contained on the surface of the roller. For example, the surface of the roller is prepared with a water-adsorptive material or a mechanism is provided so that the constant amount of processing solution can be supplied to the surface of the roller.

Furthermore, a silver halide photographic light-sensitive material may occasionally be termed simply a light-sensitive-material, which includes color paper, color film, black-and-white film, graphic arts film, radiographic film, etc.

The processing solution covers developer, color developer, fixer, bleach, bleach-fixer, non-water wash stabilizer, stabilizer, rinse, water wash, small amount of wash water, extra-washing water, etc.

Furthermore, the roller having a processing solution-containing function is a roller composed of a water-absorptive material so as to be impregnated with processing solution.

A light-sensitive material is conveyed by the roller having a processing solution-containing function from the low end to the top through air and from the upper part, the processing solution is supplied to the roller and/or the light-sensitive material. Thus, the light-sensitive material is brought into contact with the processing solution held in the lower roller and is then brought into contact with the processing solution held in the upper roller. Accordingly, every time when conveyed by the roller, the light-sensitive material is successively processed with the processing solution with less contamination (lower concentration of dissolved-out materials from the light-sensitive material). Eventually, the system is that the processing solution is flowed against the conveying direction of the light-sensitive material and comprises functions which are the same as these of a conventional multi-step counter current system in which a plurality of processing tanks are arranged in series. Thus, the processing is carried out efficiently with a small amount of the processing solution and quick processing can be practiced.

In addition, when the processing solution is supplied from the upper position and the light-sensitive material is conveyed from the upper position to the lower position, the processing is carried out efficiently with a small amount of the processing solution. However, the preferred constitution is that as mentioned above, the processing solution is supplied from the upper position and the light-sensitive material is conveyed from the lower position to the upper position.

Furthermore, by processing a light-sensitive material at high temperature (≧40° C.) under the installation of a temperature-adjusting mechanism, it has became possible to shorten remarkably a processing time and to reduce a conveying path length. Because there is no need to arrange a plurality of processing tanks in series as employed in the conventional multi-step counter current system, it has become possible to decrease markedly the dimensions of a processor.

Namely, the functional advantages contribute to practice the decease in the replenisher amount, the increase in processing speed and the decease in dimensions of a processor. It is noted that the number of rollers arranged in vertical direction corresponds to the number of processing tanks arranged in series.

Furthermore, the processing solution supplying system is a system which supplies the amount corresponding to that of a light-sensitive material to be processed and a residing amount is equivalent to the amount to secure only the amount held by rollers, etc. Accordingly, the renewal frequency of a processing solution is large and under performing a quick processing, the processing solution is renewed rapidly before aerial oxidation during storage is caused as a problem no oxide precipitates are formed on rollers.

The roller having a processing solution-containing function is preferably composed of materials such as woven fabrics, unwoven fabrics, sintered body, sponge, etc. which bear chemical resistance and is preferably soft for the prevention of abrasion and scratch formation. And the roller surface is preferably covered with a water-absorptive or water-absorbing material.

The materials of the woven fabrics and unwoven fabrics are preferably polyolefin series fiber, polyester series fiber, polyacrylnitrile series fiber, aliphatic polyamide series fiber, aromatic polyamide series fiber, polyphenylenesulfide fiber, etc.

The substances of porous materials (sponge series) are preferably silicone rubber, polyurethane, ethylenepropylene rubber (EPDM), polyvinyl alcohol (PVA), neoprene rubber, butyl robber series fiber, etc.

The preferred material of the roller having a processing solution-containing function is specifically a porous material which can absorbs and holds sufficiently the processing solution supplied to the roller and make it possible to operate effectively a multi-step counter current function.

The preferred structure in which the roller having a processing solution-containing function is employed is that a solution-collecting vessel is provided in the lower part of the roller and one part of the processing solution supplied from the roller in the upper position is collected in the vessel and one part of the roller is immersed into the solution in the vessel. Accordingly, even though the roller is not composed of the water-absorptive material, multi-step counter current function may be rendered. As the roller rotates, the processing solution is adhered and held on the surface of the roller, and a conveyed light-sensitive material is brought into contact with the processing solution adhered on the roller surface to undergo processing.

Further, a preferred structure is that when the roller is rotated, the solution-collecting vessel is arranged so that the solution adheres uniformly on the roller surface.

Furthermore, it is preferred to combine the roller composed of a water-absorptive material with a solution-collecting vessel.

A more preferred embodiment is that instead of rendering a roller a processing solution-containing function, a processing solution-containing member is arranged in a roller. The processing solution-containing member is arranged at least in one place of between rollers, upper part or lower part. Under such arrangement, the processing solution impregnated and held in the processing solution-containing member is brought into contact with a light-sensitive material to undergo processing. Thus, the multi-step counter current function can be born to make it possible to improve processing properties and shorten a processing time.

The processing solution-containing member may be a water-absorptive material which is impregnated with a processing solution and holds it. Examples include water-absorptive woven fabrics, unwoven fabrics, porous material as described above. This function is that the processing solution-containing member works as a guide member for a light-sensitive material and may be a means to bring directly a light-sensitive material into contact with the processing solution impregnated with the member and held in it. Or it may be a means in that by bringing the processing solution-containing member into contact with a roller, the processing solution is allowed to adhere onto the roller surface and by bringing the roller into contact with the light-sensitive material, and the processing solution is indirectly supplied to the light-sensitive material.

In the present invention, a plurality of arranged rollers are provided which convey a light-sensitive material in vertical direction. Specifically, a constitution may be employed in that pairs of rollers putting a light-sensitive material between them are arranged in vertical direction, or with a method putting a film between a roller and a plane guide member, rollers are arranged in vertical direction. The pairs of rollers may be arranged horizontally or in zigzag.

The roller having a processing solution-containing function includes, for example, one in which the surface of a roller is composed of a water-absorptive material and thus a processing solution is constantly adhered or contained on the surface of the roller to enable to supply constantly the processing solution in a constant volume, or the other which has a processing solution-containing member in at least one place between rollers, in the upper position or lower position of the rollers.

The material of the roller having a processing solution-holding function includes preferably these which are porous materials having chemical resistance and soft materials so as to prevent the formation of abrasion and scratch and which makes the roller surface water-absorptive. The roller surface is preferably covered by a water-absorptive material. These materials include, for example, woven or nonwoven fabrics such as polyolefin series fibers, polyester series fibers, aliphatic polyamide series fibers, aromatic polyamide series fibers, polyphenylene sulfide fibers, etc.; sintered compacts; silicone rubber, polyurethane, ethylenepropylene rubber (EPDM), polyvinyl alcohol (PVA), neoprene rubber, butyl rubber series fibers, etc.

Furthermore, the processing solution-containing member is preferably composed of water-absorptive material which allows it to be impregnated and hold a processing solution. Examples also include woven or nonwoven fabrics, and porous materials, etc. The processing solution-containing member may be utilized as a guiding member for light-sensitive material and the processing solution impregnated and held by the member may be brought into contact with the light-sensitive material. Or a processing solution may be adhered on the roller surface by bringing the roller in contact with the processing solution-containing material.

FIG. 1 is a schematic sectional side view of one example of the automatic processor employed in the present invention.

Development step 10 is of an immersion processing type composed of a development tank 11 and a plurality of pairs of rollers 13, and a fixing step 30 and a water washing step 40 are combined in a single tank. A downward path arranged of a plurality of paired conveyance rollers 33 attached to a solution-collecting vessels 34 is designated the fixing step 30, and an upward path arranged by a plurality of paired conveyance rollers 43 attached to the solution-collecting vessel 34 is designated a water washing step 40. In the lower parts of each step, there are a fixer-collecting section 32 and a wash water-collecting section 42. The fixer-collecting section 32 is connected with a temperature sensor 37 and a heater 36, and heated fixer solution is circulated and supplied to a light-sensitive material F by a nozzle 38 from the upper part of the downward path by a pump 36.

The pair of rollers 33 and the fixer in the solution-collecting vessel 34 are heated by the circulative supply of the heated fixer. Processing solutions in contact with the light-sensitive material may be successively heated by heating the roller of the paired rollers 33 and the solution-collecting vessel 34, directly by a heater H.

In the upward path, tap water is heated by a heater 75; supplied to a pair of the upper rollers 43 and the light-sensitive material F and is collected in the wash water-collecting section 42 by gravity flow. In addition, there is provided a partition board 39 between the descending section and the ascending section, a partition board 39 so that solutions are not mixed each other through scattering. Furthermore, water in the wash water-collecting section 42 and a fixer replenisher from a fixer replenisher tank 71 are supplied to the fixer collecting section 32 by a replenisher control device 72 in which pumps 73 and 74 are operated based on the amount of light-sensitive material to be processed which is detected by a sensor 81 which detects the width and length of the light-sensitive material. A drying step 60 follows the water washing step 40 and the light-sensitive material F is dried and wound.

Data detected by the sensor 81 may be utilized not only to control the replenisher amount of the fixer replenisher but also to control the replenisher amount of stabilizer or washing water. Furthermore, when the standard size of the light-sensitive material is processed, processing may be carried out by inputting previously programmed suitable replenisher amount without utilizing the information from the sensor 81.

It is possible to practice a method in which, in the same manner as for a development tank, a developer as a circulating processing solution showers the upper roller in the arrangement of a paired rollers attached to a solution-collecting-vessel.

The fixer supplied from a nozzle 38 above the paired rollers 33 flows uniformly onto the paired rollers 33 and is then collected in the solution-collecting vessel 34 attached to each the paired rollers 33. The collected fixer is supplied to the surface of the light-sensitive material F, conveyed by the rotation of the roller while being put between them and the light-sensitive material F is thus processed: or the fixer is transported to the lower roller and the solution-collecting vessel 34, or is caused to overflow from the upper solution-collecting vessel 34 and then flows down to the lower roller and the solution-collecting vessel and is supplied onto the light-sensitive material F conveyed from the upper part by the rotation of the lower roller, while processing is carried out.

Figure 2:
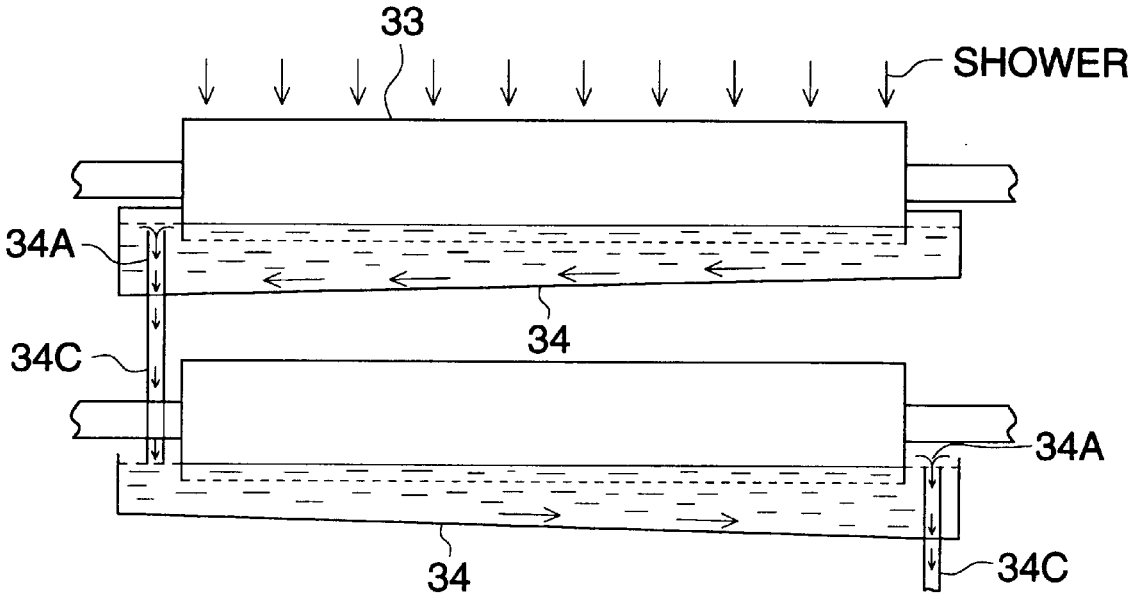
FIG. 2 shows a schematic structure of the roller arrangement of the automatic processor according to the present invention.

FIG. 2 shows a front sectional view of one example of paired rollers integral with a solution-collecting vessel.

According to FIG. 2, at the bottom of the solution-collecting vessel 34, an incline is formed against the roller axial direction. Thus a processing solution supplied by gravity flow from the upper part flows smoothly in the roller axial direction and the supply of a processing solution to the light-sensitive material F becomes uniform, enabling the roller surface in the solution-collecting vessel until reaching an overflow outlet 34A to immerse uniformly with the solution. Furthermore, the overflowed processing solution flows to the lower solution-collecting vessel through a pipe 34C from the upper position. Methods may be employed in that a solution is flown from the center to the edge or a processing solution is fallen after dividing to several portions and then flowed in the roller axial direction.

Figure 4:
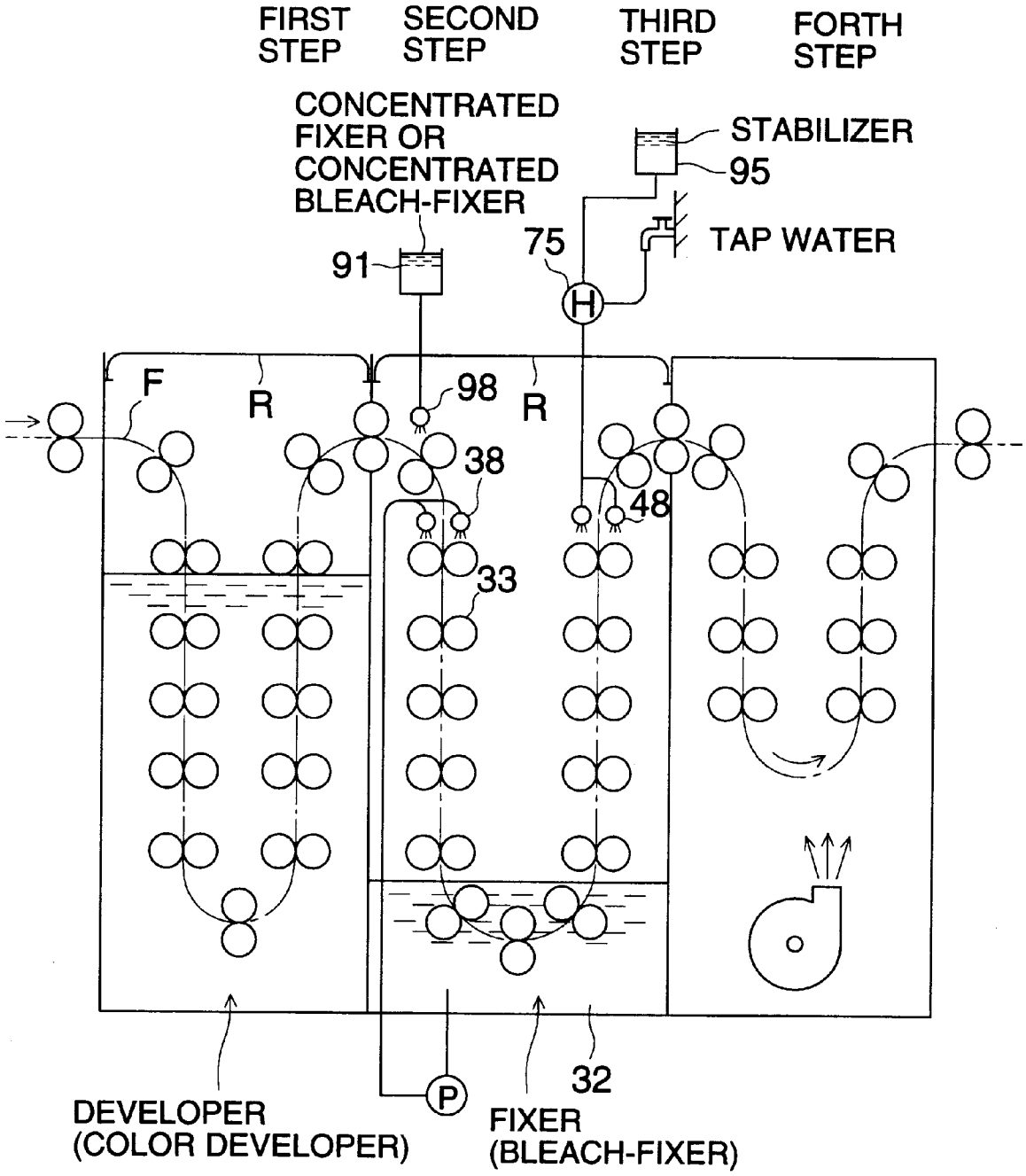
FIG. 4 shows a schematic structure of the automatic processor according to the present invention.

The schematic sectional side view of an automatic processor shown in FIG. 4 is one of the representative automatic processors according to the present invention. Along with the illustration of the capability of multi-functional processing, it also illustrates that for the decrease in weight and simplification, it is possible to remove a partition board between the second step of fix or bleach-fix and the third step of wash or stabilize. Namely, the supply as fresh solution of each circulating processing solution, concentrated processing solution, tap water or stabilizer from the upper direction or the supply of circulating processing solution from the solution-collecting vessel 32 in the lower part is a suitable amount near minimum requirement. Accordingly, the processing solution in the lower solution-collecting vessel 32 works constantly an appropriate fixer or bleach-fixer and is not scattered to surroundings and enables the efficient contact with the light-sensitive material F.

Further, the fixer or bleach-fixer stayed in the processing collecting vessel 32 in the lower part is constantly kept in the state having appropriate concentration is employed through circulation while being sprayed from the nozzle 38 in the upper position.

Further, the fresh solution of the fixer or bleach-fixer is suitably supplied through the nozzle 91 from an upper supply tank 91.

Further, when wash water is employed, the suitable amount of tap water is supplied. However, when a stabilizer is employed, its temperature is optimally adjusted through a heater 75 from a stabilizer tank 95 in the upper position and it is supplied from the nozzle 48.

Further, It is desired that in each circulation path, a temperature sensor and a heater are provided together with a pump.

(Fixer)

The fixer of the present invention has a chlorine concentration of 0.8 to 1.9 mole/l (preferably from 1 to 1.8 mole/l), and comprises at least one compound selected from polyalkylene oxide, sugars represented by general formula (1) and alklylsulfonic acids represented by the general formula (2), and comprises preferably tartaric acids (tartaric acid or its salts) or gluconic acids (gluconic acid or its derivatives or its salts), and further comprises no boric acids.

In the present invention, the salt concentration of the fixer refers to the total concentration of all the compounds composing the fixer. Though compounds comprised in the fixer are somewhat different in the composition, there may be illustrated, as representative compounds, fixing agents such as thiosulfate salts, thiocyan compounds, mesoion compounds, etc.; buffer agents such as acetic acid and its salts, β-alanine, etc.; hardeners such as potassium alum, glutaraldehyde, etc.; preservatives for the fixing agents such as sulfite salts, etc.; stabilizers for aluminum compounds such as boric acid or its salts, citric acid or its salts, tartaric acid or its salts, gluconic acid or its salts, etc.; pH-adjusting agents such as acetic acid, sulfuric acid, etc.; chelating agents capable of softening hard water: wetting agents such as surface active agents, and the like. The minimum concentration capable of providing performance required of a fixer (fixability, drying properties, running stability) is 0.8 mole/l.

As polyalkylene oxide compounds, various compounds may be employed and preferably are these represented by the following general formula (3-a), (3-b) and (3-c).

General formula (3-a)

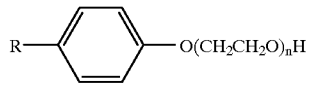

wherein R represents an alkyl group having from 1 to 15 carbon atoms and n represents an integer of 15 to 50.

General formula (3-b)

$$HO(CH_2CH_2O)_m-(CHCH_2O)_l(CH_2CH_2O)_nH \quad (CH_3)$$

General formula (3-c)

$$HO(CH_2CH_2O)_{m'}(CH_2CH_2CH_2O)_{l'}(CH_2CH_2O)_{n'}H$$

wherein 1 and 1' each independently represents an integer of 10 to 30, and m+n and m'+n' each independently represents an integer of 10 to 40.

Specific examples of preferred polyalkylene oxide compounds are shown below.

2-1

$$nC_9H_{19}O(CH_2CH_2O)_{20}H$$

-continued 2-2

$nC_8H_{17}O(CH_2CH_2O)_{30}H$ 2-3

$nC_{12}H_{25}O(CH_2CH_2O)_{30}H$ 2-4

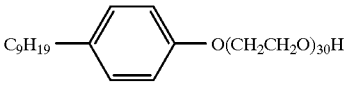

2-5

$nC_{12}H_{25}S(CH_2CH_2O)_{30}H$ 2-6

$C_4H_9S(CH_2CH_2O)_{30}COCH_2CH_2COOH$ 2-7

$C_{12}H_{25}O(CH_2CH_2O)_m(CH_2)_5(CH_2CH_2O)_nH$ (m + n =70)

2-8

$HO(CH_2CH_2O)_m(CH(CH_3)CH_2O)_{17}(CH_2CH_2O)_nH$ (m + n =17)

2-9

$HO(CH_2CH_2O)_m(CH(CH_3)CH_2O)_{35}(CH_2CH_2O)_nH$ (m + n =30)

2-10

$HO(CH_2CH_2O)_m(CH(C_2H_5)CH_2O)_{15}(CH_2CH_2O)_nH$ (m + n =15)

2-11

$HO(CH_2CH_2O)_m(CH(C_2H_5)CH_2O)_{15}(CH_2CH_2O)_nH$ (m + n =30)

2-12

$HO(CH_2CH_2O)_m(CH_2CH_2CH_2CH_2O)_{21}(CH_2CH_2O)_nH$ (m + n =21)

2-13

$HO(CH_2CH_2O)_m(CH_2CH_2CH_2CH_2O)_{15}(CH_2CH_2O)_nH$ (m + n =38)

2-14

$HO(CH_2CH_2O)_m(CH(CH_2OC_2H_5)CH_2O)_{15}(CH_2CH_2O)_nH$ (m + n =15)

2-15

$HO(CH_2CH_2O)_m(CH(CH_2OC_3H_7)CH_2O)_{15}(CH_2CH_2O)_nH$ (m + n =15)

2-16

$nC_{12}H_{23}O(CH(CH_3)CH_2O)_7(CH_2CH_2O)_{30}H$ 2-17

$nC_{12}H_{25}O(CH(CH_3)CH_2O)_7(CH_2CH_2O)_{30}H$ 2-18

$HOOCCH_2CH_2-C(=O)O(CH_2CH_2O)_m(CH_2CH_2CH_2CH_2O)_{15}-C(=O)(CH_2CH_2O)_nCOCH_2CH_2COOH$ (m + n = 15)

2-19

$HOOCCH_2CH_2C(=O)O(CH_2CH_2O)_m(CH_2CH_2CH_2CH_2O)_{20}-C(=O)(CH_2CH_2O)_nCOCH_2CH_2COOH$ (m + n = 15)

-continued 2-20

$C_{12}H_{25}N((CH_2CH_2O)_mH)_2$ (m + n = 30)

2-21

$HO(CH_2CH_2O)_m(CH(CH_3)CHO)_{20}(CH_2CH_2O)_nH$ (m + n = 15)

2-22

$HO(CH_2CH_2O)_m(CH(CH_3)CHO)_{30}(CH_2CH_2O)_nH$ (m + n = 25)

The amount of polyalkylene oxides added to a fixer is preferably between $1\times10^{-5}$ and $2.5\times10^{-3}$ mole/l. Furthermore, the polyalkylene oxides may be employed individually or in combinations of a plurality of them.

The preferred structure of the compound represented by the general formula (1) is shown by the following general formula (1-a).

General formula (1-a)

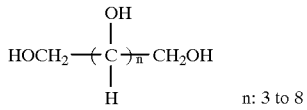

n: 3 to 8

The specific examples of compounds represented by the general formula (1-a) are shown below. These compounds are composed of structural isomers and all the isomers are included in the present invention.

1-1

$ClCH_2-(CHOH)_4-CH_2Cl$ 1-2

$ClCH_2-(CHOH)_8-CH_2Cl$ 1-3

$HOOC-CH_2-(CHOH)_3-CH_2COOH$ 1-4

$HOOC-CH_2-(CHOH)_4-CH_2COOH$ 1-5

$HO-CH_2-(CHOH)_3-CH_2OH$ 1-6

$HO-CH_2-(CHOH)_4-CH_2OH$ 1-7

$HO-CH_2-(CHOH)_6-CH_2OH$ 1-8

$HO-CH_2-(CHOH)_8-CH_2OH$

Of the above-mentioned compounds, D-mannitol and sorbitol, which are structural isomers of 1–6 are preferred. The added amount ranges preferably from $5\times10^{-4}$ to $10^{-1}$ mole/l and ranges more preferably from $2\times10^{-3}$ to $1.5\times10^{-3}$ mole/l and ranges further more preferably from $4\times10^{-3}$ to $6\times10^{-2}$ mole/l.

In the general formula (2), n is preferably between 6 and 9, and alkali metals represented by M are Na, K, Li and the like.

Specific examples of compounds represented by the general formula (2) are shown below. However, the compounds are not limited to these examples.

| No. | n | m | M |
|---|---|---|---|
| 2-1 | 4 | 0 | Na |
| 2-2 | 4 | 0 | K |
| 2-3 | 4 | 1 | Na |
| 2-4 | 5 | 0 | Na |
| 2-5 | 5 | 0 | K |
| 2-6 | 5 | 1 | Na |
| 2-7 | 6 | 0 | Na |
| 2-8 | 6 | 0 | K |
| 2-9 | 6 | 1 | Na |
| 2-10 | 6 | 0 | K |
| 2-11 | 7 | 0 | Li |
| 2-12 | 7 | 0 | Na |
| 2-13 | 7 | 0 | K |
| 2-14 | 7 | 1 | Li |
| 2-15 | 7 | 1 | Na |
| 2-16 | 7 | 1 | K |
| 2-17 | 8 | 0 | Na |
| 2-18 | 8 | 0 | K |
| 2-19 | 8 | 1 | Na |
| 2-20 | 8 | 1 | K |
| 2-21 | 9 | 0 | Na |
| 2-22 | 9 | 1 | Na |
| 2-23 | 9 | 0 | K |
| 2-24 | 9 | 1 | K |
| 2-25 | 10 | 0 | Na |
| 2-26 | 10 | 0 | K |
| 2-27 | 10 | 1 | K |
| 2-28 | 11 | 0 | Na |
| 2-29 | 11 | 1 | K |
| 2-30 | 12 | 0 | K |
| 2-31 | 12 | 1 | Na |
| 2-32 | 13 | 0 | Na |
| 2-33 | 14 | 0 | Na |
| 2-34 | 15 | 0 | Na |

The added amount of the compound represented by the general formula (2) is preferably between about $2\times10^{-4}$ and about $1\times10^{-1}$ mole/l, and more preferably between $2\times10^{-3}$ and $5\times10^{-2}$ mole/l.

In the present invention, the added amount of tartaric acid is from about 0.1 to about 10 g/l and preferably from 0.5 to 5 g/l.

Gluconic acids employed in the present invention may be anhydrides forming a lactone ring. Preferably these are gluconic acid, its alkali salts and ammonium salts. The added amount of gluconic acids is between about 0.005 and about 0.2 mole/liter and preferably between 0.005 and 0.1 mole/l. Gluconic acids may be employed individually or in combination of two or more.

Furthermore, gluconic acids are preferably employed in combination with organic acids such as maleic acid, citric acid, succinic acid, oxalic acid, maleic acid, glycolic acid, benzoic acid, salicylic acid, tiron, ascorbic acid, glutaric acid, adipic acid, etc.; amino acids such as asparagic acid, glycine, cysteine, etc.; aminopolycarboxylic acids such as ethylenediaminetetraacetic acid (EDTA), diethylenetriaminepentaacetic acid (DTPA), 1,3-propanediaminetetraacetic acid, nitrilotriacetic acid, etc. Particularly, combinations of gluconic acids with the above-mentioned tartaric acids are preferred.

The fixer of the present invention comprises preferably no boric acids such as $H_3BO_3$ and its salts, $B_2O_5$ salts, $B_4O_7$ salts (as the kind of cations , K, NA, Li, etc.), etc.

The concentration of ammonium ions in the fixer ranges from 0.1 or less per 1 liter of the fixer, and ranges preferably from 0 to 0.05 mole per liter of the fixer.

As the fixing agent, sodium thiosulfate may be employed instead of ammonium thiosulfate, and ammonium thiosulfate and sodium thiosulfate may be employed in combination.

The concentration of acetic acid ions in the fixer is preferably 0.33 mole/l or less. More preferably, it is 0.22 mole/liter or less and most preferably 0.13 mole/l or less. Under such concentration, the generation amount of acetic acid gas can be markedly reduced. However, most preferably, the fixer comprises substantially no acetic acid.

(Light-sensitive Materials)

The environmental protection has been much concerned year by year and the shortage of water has caused problems. Therefore, the measure to cope with both aspects is required. However, when the contrast-increasing agent is dissolved out from a light-sensitive material to a developer, development performances vary. When the amount of developer replenisher is decreased, this trend is enhanced. As a result, a trend is that the diffusion of the contrast-enhancing agent is prevented so that it is not dissolved out from the light-sensitive material to the developer. Accordingly, the light-sensitive material from which additives are hardly dissolved out and which has poor washing efficiency has been prepared. Thus problems are caused in that the amount of washing water is not deceased without resulting the formation of stain in the light-sensitive material and the automatic processor.

Namely, In order to solve the technical problem to coexist the decrease in the amount of wash water with the prevention of the formation of stain, the following points must be taken into account.

(a) A contrast-increasing agent is required which does not bring staining to a drying step. Conventional contrast-increasing agents comprise a diffusion-resistant group in order to immobilize them near grains and thus, dissolving-out properties have been degraded.

(b) Most automatic processors comprise one water wash tank and result in poor washing efficiency. As a result, it has been impossible to decrease the amount of wash water because in order to increase washing efficiency though it may be little, water supply is increased and wasted as it does.

(c) In spite of that, the stain formation on rollers of the automatic processor has been eliminated and the periodical cleaning of the automatic processor has not be avoided.

When the light-sensitive material comprising at least one compound selected from hydrazine derivatives and quaternary onium salt compounds is processed, the advantages of the present invention are fully exhibited.

The hydrazine derivatives are preferably represented by the following general formula (H).

General formula (H)

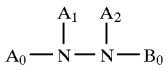

In the general formula (H), $A_0$ represents an aliphatic group, an aromatic group or a heterocyclic group, and the aliphatic group represented by $A_0$ comprises preferably between 1 and 30 carbon atoms and is preferably a straight, branched or cyclic alkyl group particularly having from 1 to 20 carbon atoms. Specific examples include a methyl group, an ethyl group, a t-butyl group, an octyl group, a cyclohexyl group, a benzyl group, etc. and these groups may be substituted with a suitable substituent (for example, an aryl group, an alkoxy group, an aryloxy group, a sulfamoyl group, an acylamino group, an ureido group).

The aromatic group represented by $A_0$ is preferably an aryl group having a monocyclic ring or condensed ring and includes, for example, a benzene ring or a naphthalene ring. The heterocyclic group represented by $A_0$ is preferably a monocyclic ring or condensed ring, and a heterocyclic ring comprising at least one hetero atom selected from a nitrogen, sulfur or oxygen atom. There are listed, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, a furan ring, etc.

As $A_0$, these particularly preferred are the aryl group and the heterocyclic group. The aromatic group and the heterocyclic group of $A_0$ have preferably a substituent. Preferred groups include, for example, an alkyl group, aralkyl group, an alkenyl group, an alkynyl group, an alkoxy group, a substituted amino group, an acylamino group, a sulfonylamino group, an ureido group, an urethane group, an aryloxy group, a sulfamoyl group, a carbamoyl group, an alkylthio group, an arylthio group, a sulfothio group, sulfinyl group, a hydroxyl group, a halogen atom, a cyano group, a sulfo group, an alkyloxycarbonyl group, an aryloxycarbonyl group, an acyl group, an alkoxycarbonyl group, an acyloxy group, a carbonamide group, a sufonamide group, a carboxyl group, a phosphoric acid amide group and the like. Furthermore, these groups may be substituted.

Of these groups, when processing is carried out for the total processing time (dry to dry) of not longer 60 seconds or employing a developer having a pH of not larger than 10.5, a substituent comprising an acidic group having a pKa of 7 to 11 is preferred. Specifically, there are shown a sulfonamide group, a hydroxyl group, a mercapto group, etc. and the sufonamide is particularly preferably shown.

Furthermore, $A_0$ preferably comprises at least one of diffusion-resistant groups or silver halide-adsorbing groups. The diffusion-resistant groups are preferably ballast groups which are generally employed as immobilizing photographic additives such as couplers. The ballast groups include photographically inactive groups having eight or more of carbon atoms such as, for example, an alkyl group, an alkenyl group, an alkynyl group, an alkoxy group, a phenyl group, a phenoxy group, an alkylphenoxy group and the like.

The silver halide-adsorbing groups include thiourea, a thiourethane group, a mercapto group, a thioether, a thione group, a heterocyclic group, a thioamide heterocyclic group, a mercapto heterocyclic group, or an adsorbing group described in Japanese Patent Publication Open to Public Inspection No. 64-90439.

$B_0$ represents a blocking group and has preferably a structure of:

$—G_0—D_0$.

$G_0$ represents a —CO— group, a —COCO— group, —CS— group, $—C(=NG_1D_1)$ group, a —SO— group, a $SO_2$ group, or a $—P(O)(G_1D_1)$ group. $D_1$ represents a aliphatic group, an aromatic group, a heterocyclic group or a hydrogen atom. When a plurality of $D_1$ are present in a molecule, these may be different or the same.

$D_0$ represents a hydrogen atom, an aliphatic group, an aromatic group, a heterocyclic group, an amino group, an alkoxy group, an aryloxy group, an alkylthio group or an arylthio group.

Preferred $G_0$ includes a —CO— group and a —COCO— group, and the particularly preferred is the —COCO— group. Preferred $D_0$ includes a hydrogen atom, an alkoxy group, an amino group and the like.

$A_1$ and $A_2$ represent hydrogen atoms at the same time, or one represents a hydrogen atom and the other represents an acyl group (acetyl, trifluoroacetyl, benzoyl, etc.) or an oxalyl group (ethoxalyl, etc.).

Next, specific examples of the compounds represented by the general formula (H) are shown below. However, the present invention is not limited to these examples.

H-1

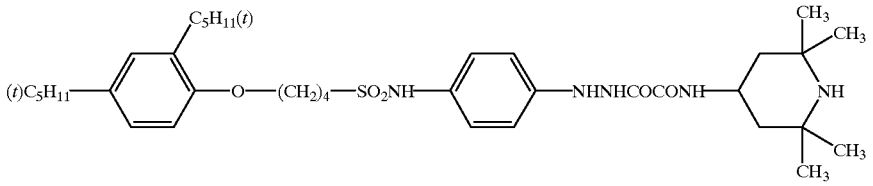

H-2

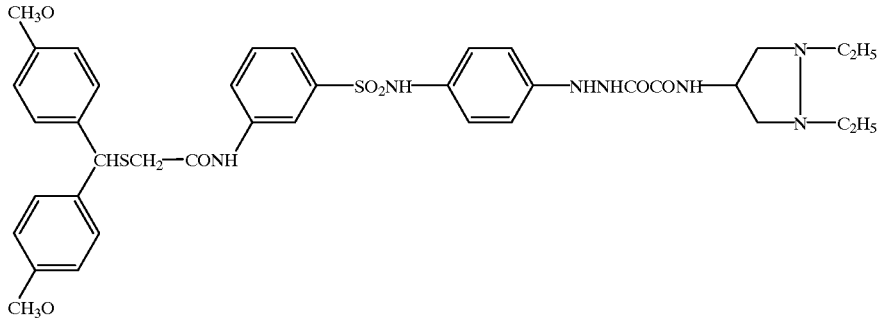

H-3

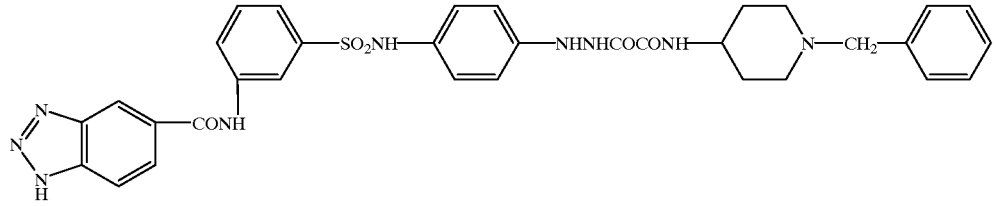

-continued
H-4
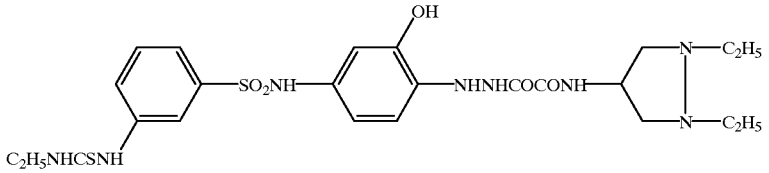
H-5
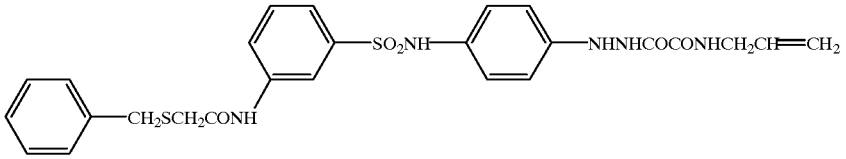
H-6
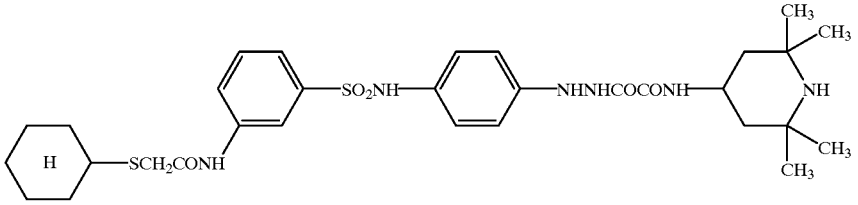
H-7
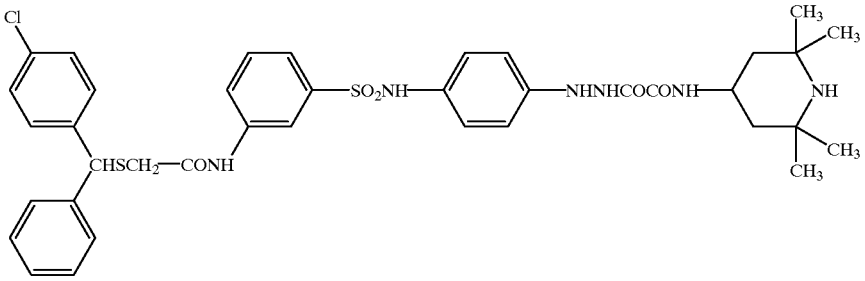
H-8
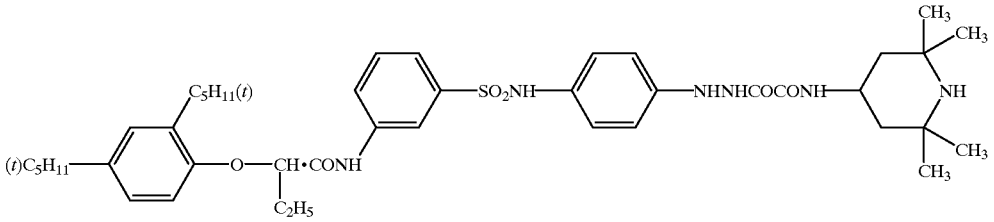
H-9
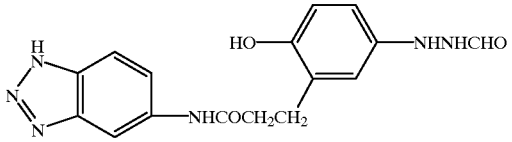
H-10
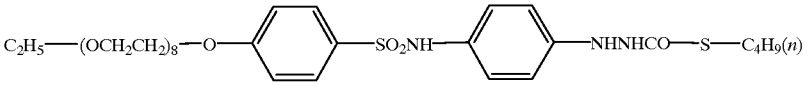
H-11
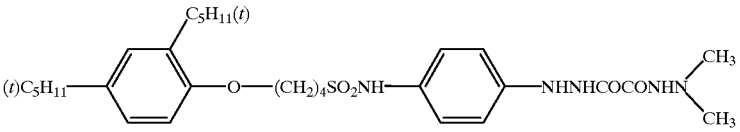

-continued
H-12
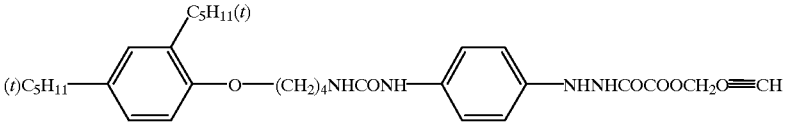
H-13
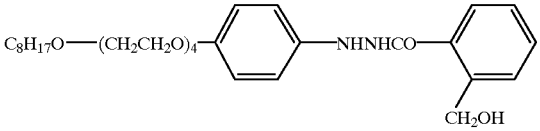
H-14
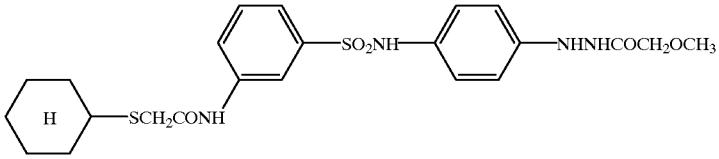
H-15
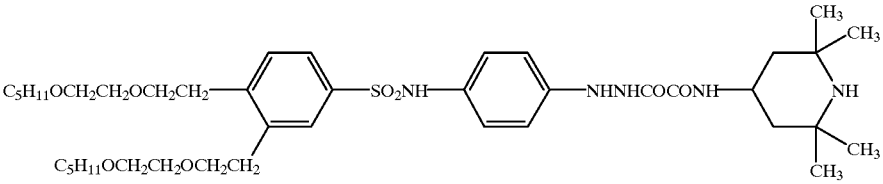
H-16
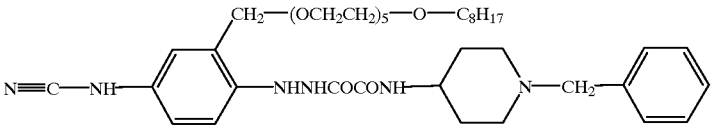
H-17
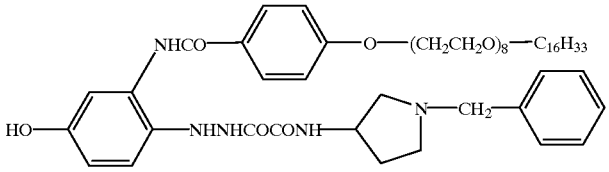
H-18
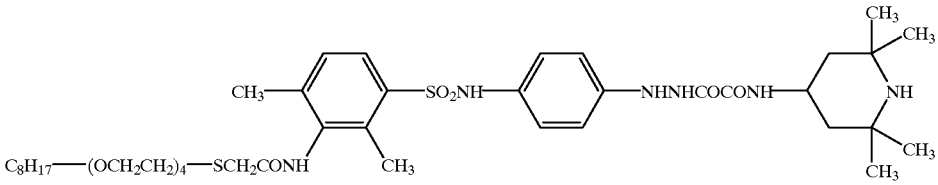
H-19
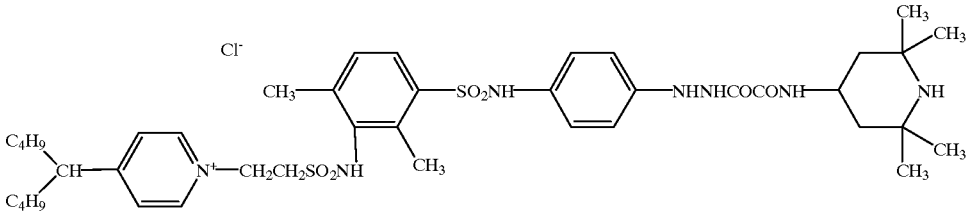

-continued
H-20
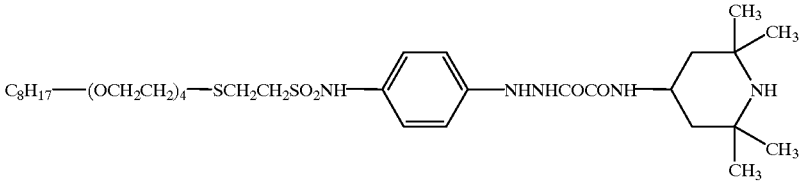
H-21
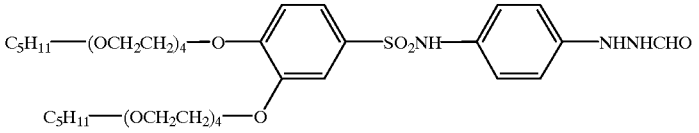
H-22
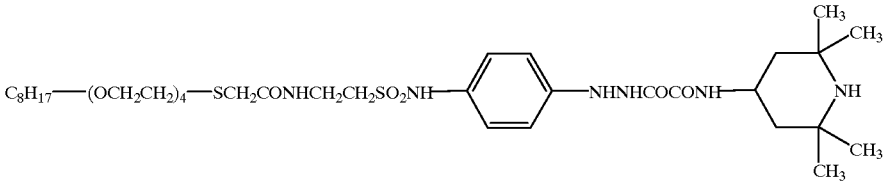
H-23
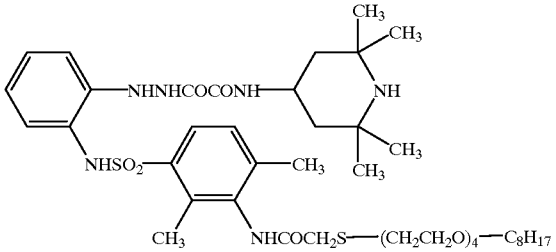
H-24
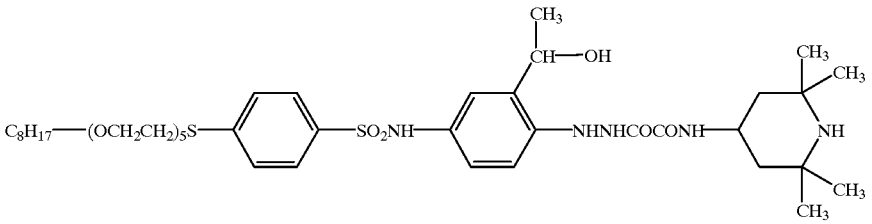
H-25
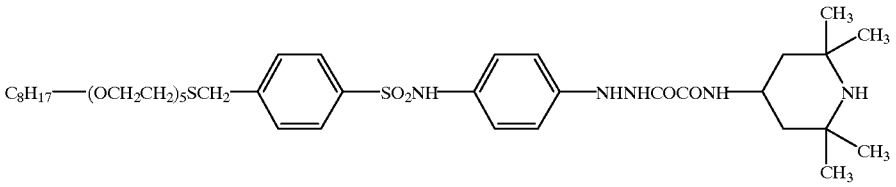
H-26
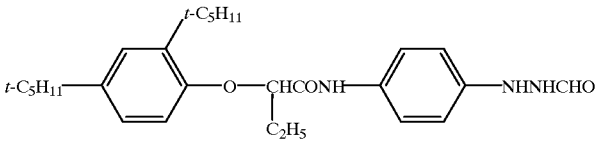

-continued
H-27
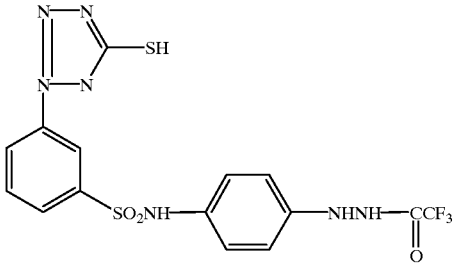
H-28
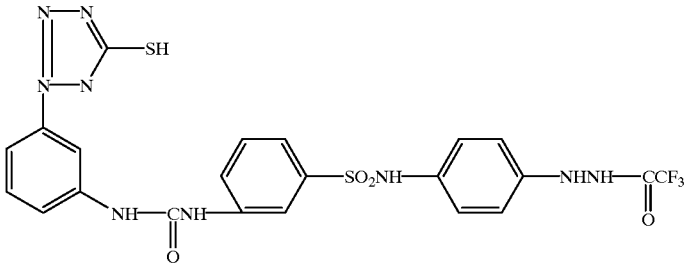
H-29
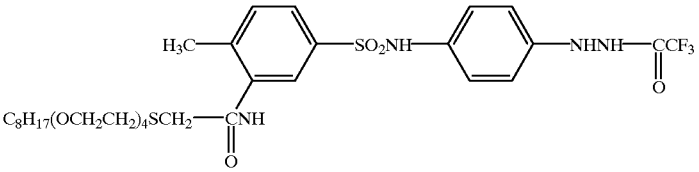
H-30
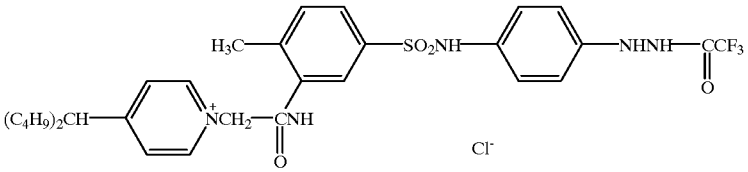
H-31
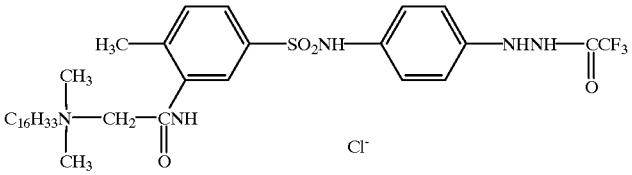
H-32
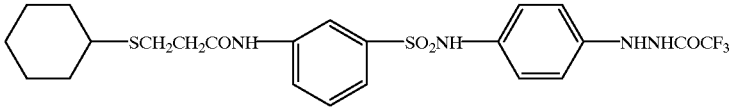
H-33
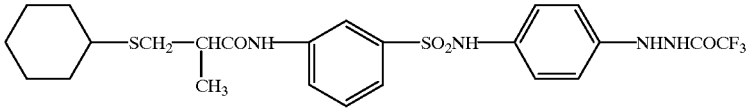
H-34
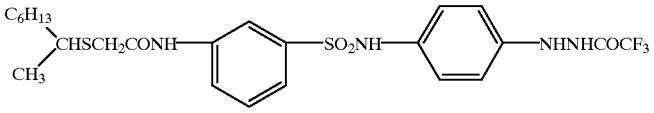

-continued
H-35
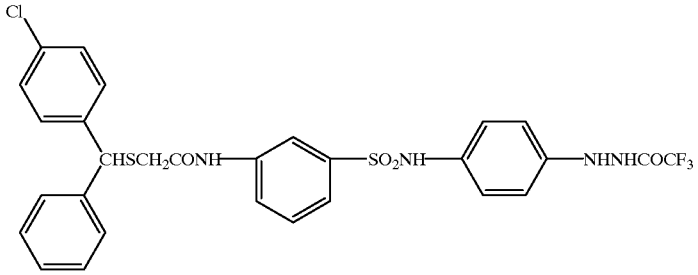
H-36
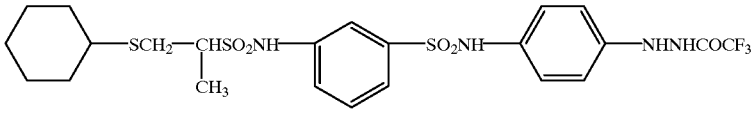
H-37
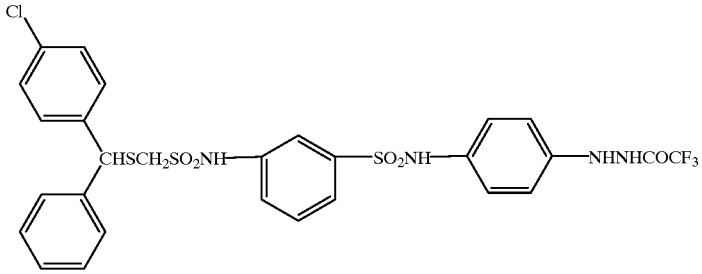
H-38
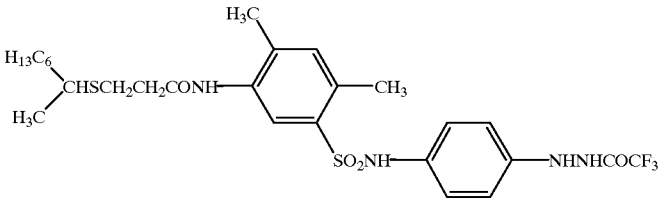
H-39
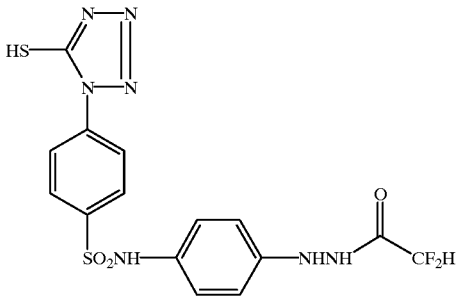
H-40
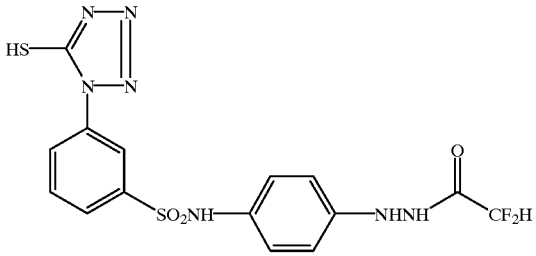

-continued
H-41
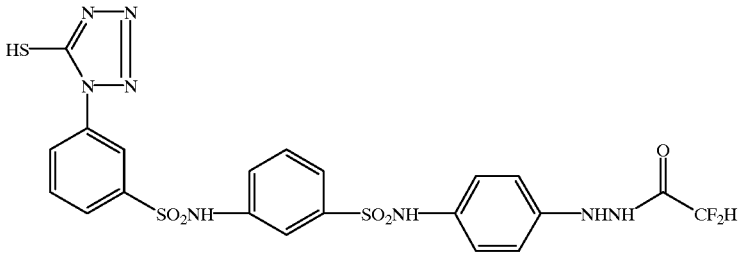
H-42
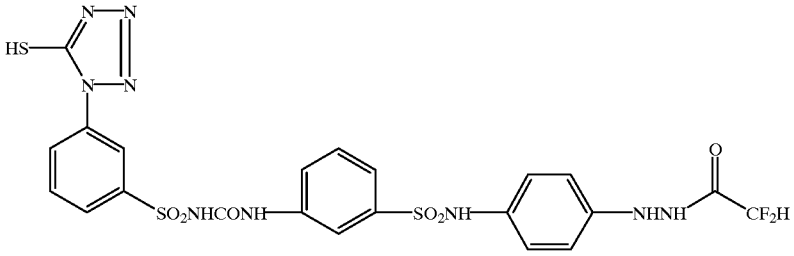
H-43
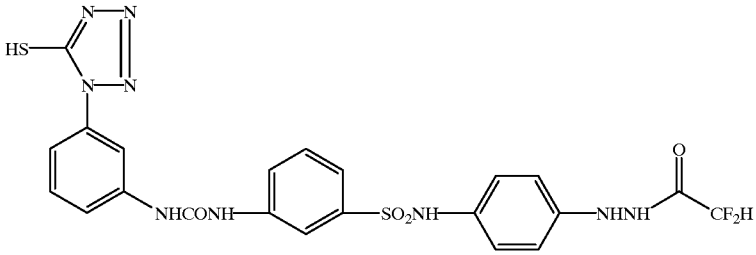
H-44
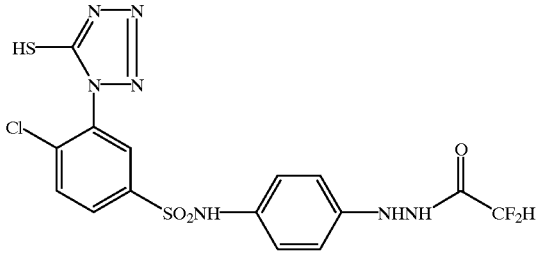
H-45
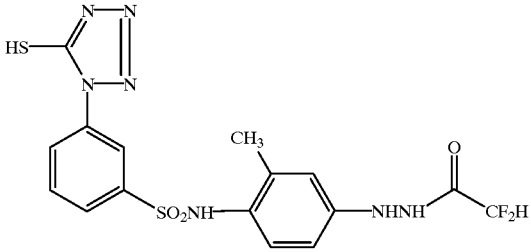
H-46
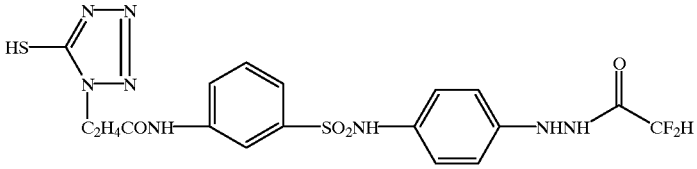

-continued
H-47
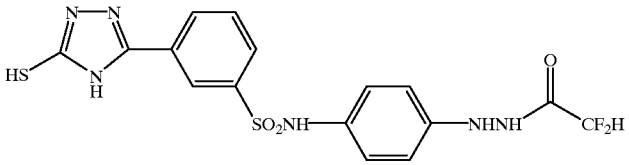
H-48
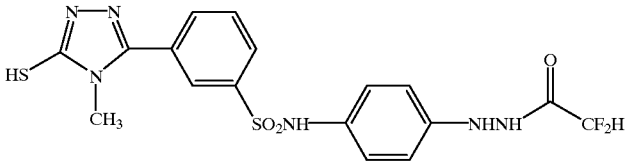
H-49
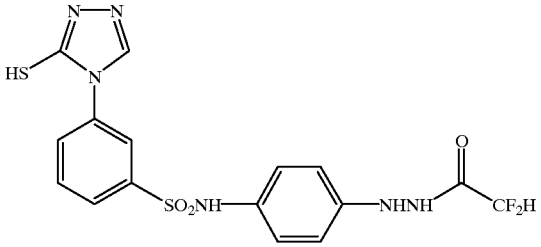
H-50
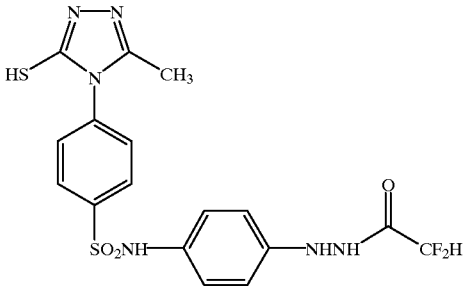
H-51
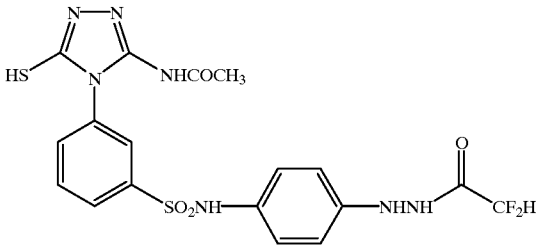
H-52
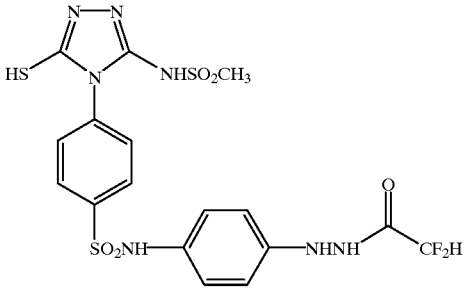

-continued
H-53
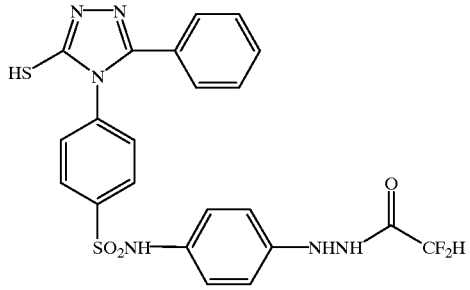
H-54
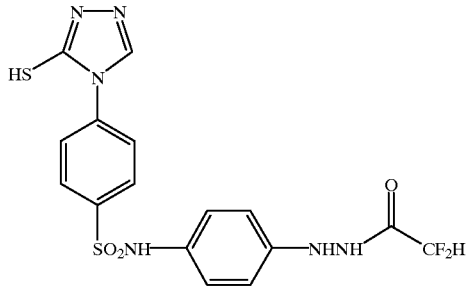
H-55
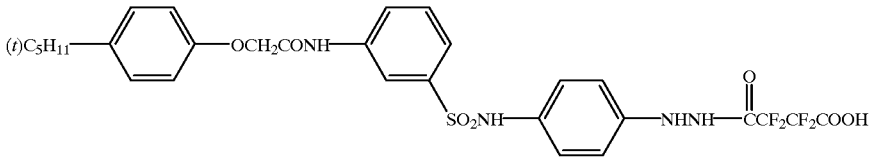
H-56
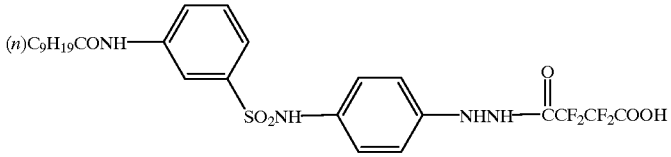
H-57
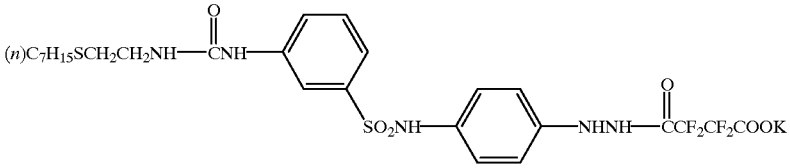
H-58
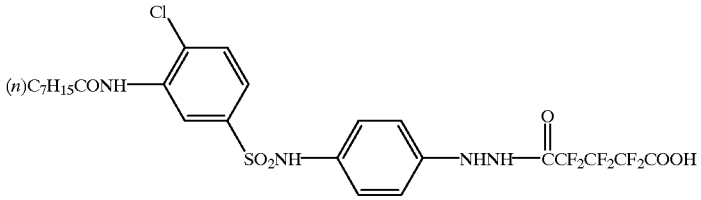
H-59
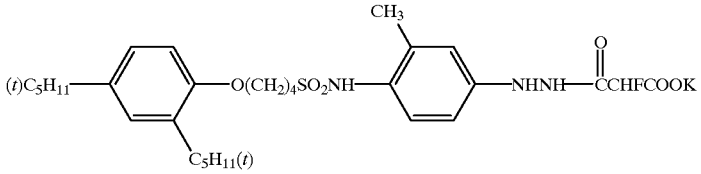

-continued

H-60

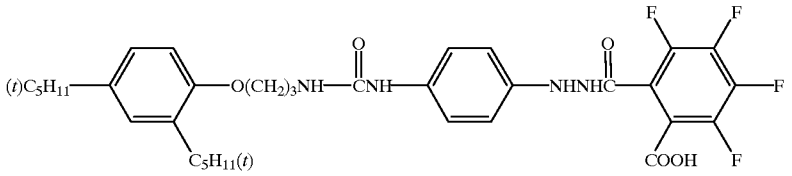

H-61

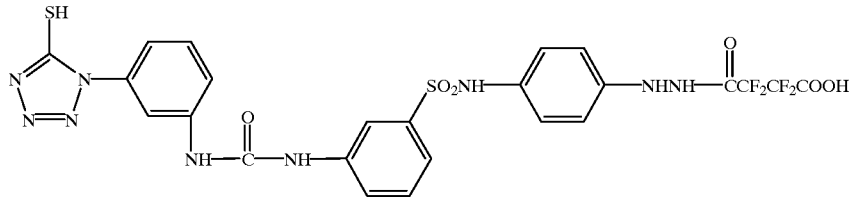

H-62

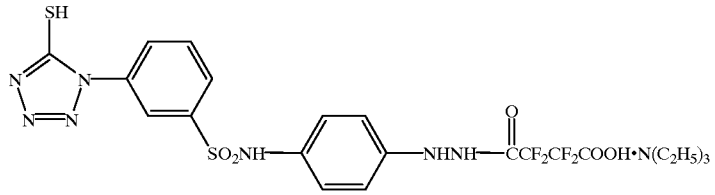

H-63

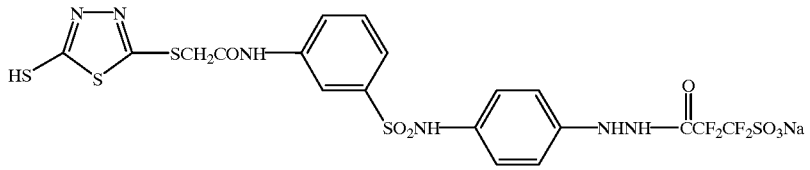

When a hydrazine derivative is comprised, in order to enhance effectively the increase in contrast caused by the hydrazine derivative, nucleation-accelerating agents represented by the following general formula (Na) or (Nb) are preferably employed.

General formula (Na)

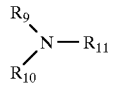

General formula (Nb)

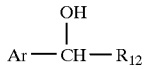

In the general formula (Na) $R_9$, $R_{10}$ and $R_{11}$ each independently represents a hydrogen atom, an alkyl group, a substituted alkyl group, an alkenyl group, a substituted alkenyl group, an alkynyl group, an aryl group or a substituted aryl group. $R_9$, $R_{10}$ and $R_{11}$ may complete a ring.

Particularly preferred compounds are these of tertiary amines. These compounds preferably comprise a diffusion-resistant group or a silver halide-adsorbing group in the molecule. In order to comprise the diffusion-resistant group, compounds having a molecular weight of 100 or more are preferred and these having a molecular weight of 300 or more are particularly preferred. Furthermore, preferred adsorbing groups include a heterocyclic group, a mercapto group, a thioether group, a thione group, a thiourea group and the like.

Further, as preferred examples represented by the general formula (Na), compounds represented by the following general formula (Na—a) are shown.

General formula (Na-a)

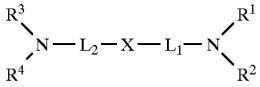

In the general formula (Na—a), $R^1$, $R^2$, $R^3$ and $R^4$ each independently represents a hydrogen atom, an alkyl group, a substituted alkyl group, an alkenyl group, a substituted alkenyl group, an alkynyl group, a substituted alkynyl group, an aryl group, a substituted aryl group, or a saturated or unsaturated heterocyclic ring. These may combine each other to complete a ring. Furthermore, combinations of $R^1$ and $R^2$, and $R^3$ and $R^4$ are not hydrogen atoms at the same time.

X represents a S, Se or Te atom.

$L_1$ and $L_2$ each independently represents a divalent linking group. Specifically, there are shown combinations of the following groups and these groups having a suitable substituent (for example, an alkylene group, an alkenylene group, an arylene group, an acylamino group, a sulfonamide group, etc.).

—$CH_2$—, —CH=CH—, —$C_2H_4$—, pyridyl, —N($Z_1$)— ($Z_1$ represents a hydrogen atom, an alkyl group or an aryl group.), —O—, —S—, —(CO)—, —($SO_2$)—, —$CH_2$N—. Furthermore, the linking group comprises preferably at least one of the following structures.

—($CH_2CH_2O$)—, —[C($CH_3$)$HCH_2O$]—, —[OC($CH_3$)$HCH_2O$]—, —[$OCH_2C$ (OH)$HCH_2$]—

In the following, specific examples of compounds represented by the general formula (Na) are shown.

Na-1
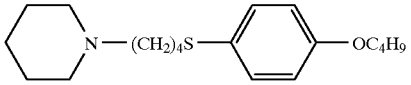
Na-2
$[(C_3H_7)_2N(CH_2)_3OCH_2CH_2]_2S$
Na-3
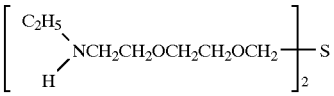
Na-4
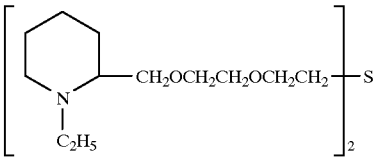
Na-5
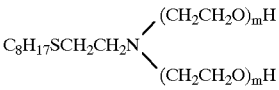
m + n = 20
Na-6
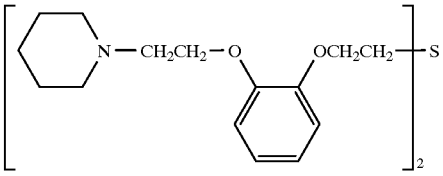
Na-7
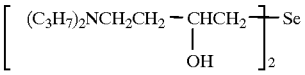
Na-8
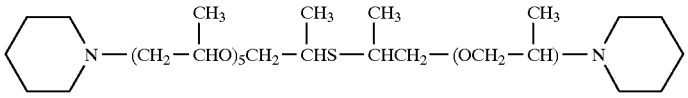
Na-9
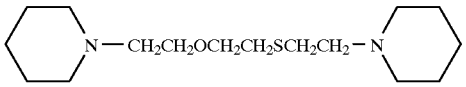
Na-10
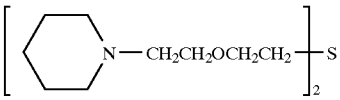
Na-11
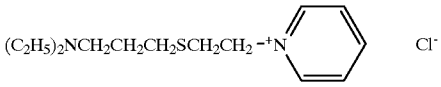
Na-12
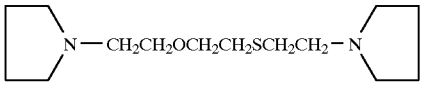
Na-13
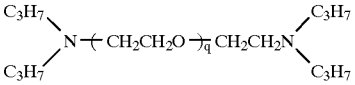

-continued

Na-14

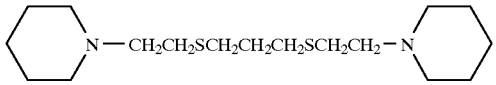

Na-15

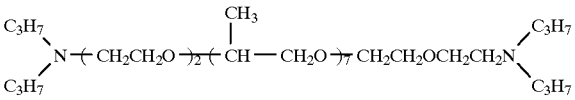

Na-16

$((C_2H_5)_2N(CH_2)_3NHCOCH_2)_2Se$

Na-17

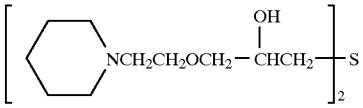

Na-18

$(C_2H_5)_2NCH_2CH_2(OCH(CH_3)CH_2)_7SCH_2CH_2N(C_2H_5)_2$

Na-19

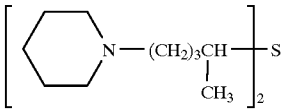

In the general formula (Nb), Ar represents a substituted or unsubstituted aromatic group or heterocyclic ring group. $R_{12}$ represents a hydrogen atom, an alkyl group, an alkynyl group, or an aryl group, and Ar and $R_{12}$ may be joined through a linking group to complete a ring. These compounds comprise preferably an diffusion-resistant group or a silver halide-adsorbing group in the molecule. For comprising the diffusion-resistant group, the molecular weight is preferably 120 or more and particularly preferably 300 or more. Furthermore, preferred silver halide-adsorbing groups are the same as these of the compounds represented by the general formula (H).

The specific examples of compounds represented by the general formula (Nb) are shown below.

Nb-1

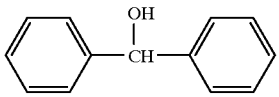

Nb-2

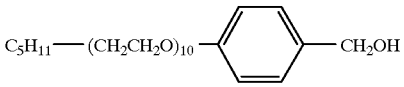

Nb-3

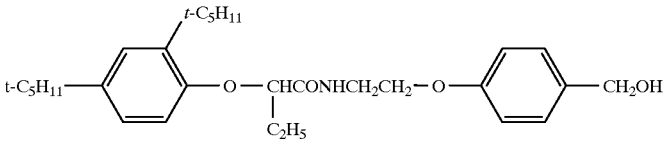

Nb-4

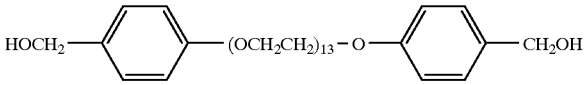

Nb-5

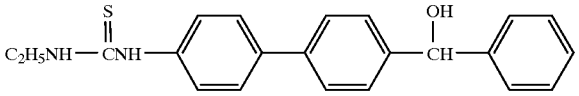

-continued

Nb-6

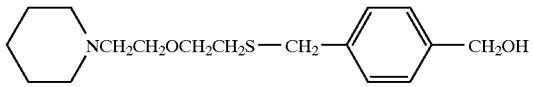

Nb-7

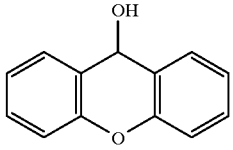

Nb-8

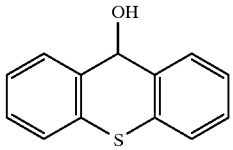

Nb-9

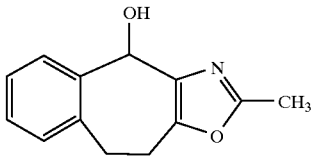

Nb-10

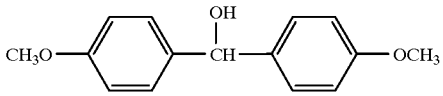

Nb-11

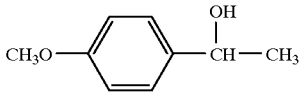

Nb-12

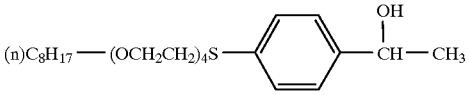

The quaternary onium compounds are these comprising a quaternary cation group of a nitrogen atom or a phosphorus atom in the molecule and the preferred compounds are these represented by the general formula (P).

General formula (P)

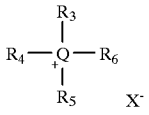

wherein Q represents a nitrogen atom or a phosphorus atom,; $R_3$, $R_4$, $R_5$ and $R_6$ each independently represents a hydrogen atom or a substituent, and $X^-$ represents an anion. Furthermore, $R_3$, $R_4$, $R_5$ and $R_6$ may join each other to complete a ring.

The substituent represented each independently by $R_3$, $R_4$, $R_5$ and $R_6$ includes an alkyl group (a methyl group, an ethyl group, a propyl group, a butyl group, a hexyl group, a cyclohexyl group, etc.), an alkenyl group (an allyl group, a butynyl group, etc.), an alkynyl group (a propargyl group, a butynyl group, etc.), an aryl group (a phenyl group, a naphthyl group, etc.), a heterocyclic group (a pyperidinyl group, a piperadinyl group, a morphonyl group, a pyridyl group, a furil group, a thienyl group, a tetrahydrofuril group, a tetrahydrothionyl group, a sulfolanyl group, etc.), an amino group and the like.

Rings which can be completed by joining $R_3$, $R_4$, $R_5$ and $R_6$ each other include a pyperidine ring, a morpholine ring, a piperadine ring, a quinuclidine ring, a pyridine ring, a pyrrole ring, an imidazole ring, a triazole ring, a tetrazole ring, and the like.

Groups represented by $R_3$, $R_4$, $R_5$ and $R_6$ may comprise a substituent such as a hydroxyl group, an alkoxy group, an aryloxy group, a carboxyl group, a sulfo group, an alkyl group, an aryl group, etc.

$R_3$, $R_4$, $R_5$ and $R_6$ each independently is preferably a hydrogen atom and an alkyl group.

Anions represented by $X^-$ include an inorganic or organic ion such as a halogen ion, a sulfate ion, a nitrate ion, an acetate ion, a p-toluenesulfonate ion.

More preferred compounds are these represented by the following general formula (Pa), (Pb) or (Pc) and the following general formula (T).

General formula (Pa)

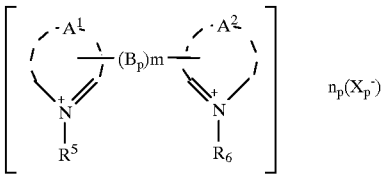

General formula (Pb)

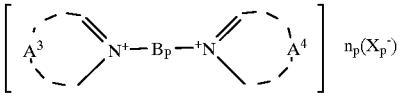

General formula (Pc)

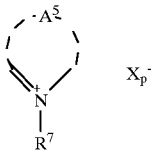

wherein $A^1$, $A^2$, $A^3$, $A^4$ and $A^5$ represent a group of nonmetallic atoms which enable to complete a nitrogen-containing heterocyclic ring, and may comprise an oxygen atom, a nitrogen atom and a sulfur atom. Benzene rings may be condensed. The heterocyclic ring formed by $A^1$, $A^2$, $A^3$, $A^4$ and $A^5$ may comprise a substituent and these may be different or the same. The substituent includes an alkyl group, an aryl group, an aralkyl group, an alkenyl group, an alkynyl group, a halogen atom, an acyl group, an alkoxycarbonyl group, an aryloxycarbonyl group, a sulfo group, a carboxyl group, a hydroxyl group, an alkoxy group, an aryloxy group, an amide group, a sulfamoyl group, a carbamoyl group, an ureido group, an amino group, a sulfonamide group, a sulfonyl group, a cyano group, a nitro group, a mercapto group, an alkylthio group, an arylthio group. The preferred examples of $A^1$, $A^2$, $A^3$, $A^4$ and $A^5$ may include 5- to 6-membered rings (each ring of pyridine, imidazole, thiozole, oxazole, pyradine, pyrimidine, etc.). As the more preferred example, the pyridine ring is shown.

$B_p$ represents a divalent linking group and m represents 0 or 1. As the divalent linking group, there are shown these formed by joining individually or in combination an alkylene group, an arylene group, an alkenylene group, —$SO_2$—, —SO—, —O—, —S—, —CO—, —N($R^8$)— ($R^8$ represents an alkyl group, an aryl group or a hydrogen atom.). $B_p$ includes preferably an alkylene group and an alkenylene group.

$R^5$, $R^6$ and $R^7$ each independently represents an alkyl group having from 1 to 20 carbon atoms. Furthermore, $R^5$ and $R^6$ may be different or the same. The alkyl group includes a substituted or unsubstituted alkyl group. The substituents are the same as these shown as the substituents of $A^1$, $A^2$, $A^3$, $A^4$ and $A^5$.

The preferred example of $R^5$, $R^6$ and $R^7$ is an alkyl group having from 4 to 10 carbon atoms. The more preferred example includes a substituted or unsubstituted aryl-substituted alkyl group.

$X_p^-$ represents an ion pair necessary for equilibrating the total charge of a molecule and represents, for example, a chloride ion, a bromide ion, a iodide ion, a nitrate ion, a sulfate ion, p-toluenesulfonate, oxalate, etc. $n_p$ represents the number of ion pairs necessary for equilibrating the total charge of the molecule. With inner complex salts, $n_p$ is 0.

General formula (T)

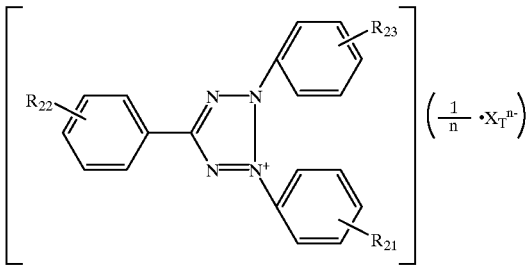

$R_{21}$, $R_{22}$ and $R_{23}$ which are substituents of the phenyl groups of a triphenyltetrazolium compound represented by the above-mentioned general formula (T), each independently represents preferably a hydrogen atom or a group having a negative Hammett's σ value (σP) which shows the degree of electron attraction.

The Hammett's σ values in a phenyl group are found in many publications, for example, C. Hansch's report in Journal of Medical Chemistry, Volume 20, page 304, 1977 and the like. Groups having particularly preferred negative σ value include, for example, a methyl group (σP=−0.17, in the following, all the values are σP.), an ethyl group (−0.15), a cyclopropyl group (−0.21), a n-propyl group (−0.13), an iso-propyl group (−0.15), a cyclobutyl group (−0.15), a n-butyl group (−0.16), an iso-butyl group (−0.20), a n-pentyl group (−0.15), a cyclohexyl group (−0.22), an amino group (−0.66), an acetylamino group (−0.15), a hydroxyl group (−0.37), a methoxy group (−0.27), an ethoxy group (−0.24), a propoxy group (−0.25), a butoxy group (−0.32), a pentoxy group (−0.34), etc. and these are useful as the substituent of the compound represented by the general formula (T).

n represents 1 or 2. Anions represented by $X_t^{n-}$ include, for example, a halide ion such as a chloride ion, a bromide ion, an iodide ion, etc.; an acid radical of an inorganic acid such as nitric acid, sulfuric acid, perchloric acid; an acid group of an organic acid such as sulphonic acid, carboxylic acid, etc.; an anion series surface active agent, specifically, a lower alkylbenzenesulfonate anion such as p-toluenesulfonate anion, etc., a higher alkylbenzenesulfonate anion such as a p-dodecylbenzenesulfonate anion, a higher alkylsulfuric acid ester anion such as a laurylsulfate anion, etc.; a boric acid series anion such as teraphenyl boron, etc.; a dialkylsulfosuccinate anion such as di-2-ethylhexylsulfosuccinate anion, etc.; a higher fatty acid anion such as cetylpolyethenohexylsulfate anion, etc.; a polymer having an acid group such as polyacrylic acid anion; etc.

In the following, specific examples of quartenary onium compounds are shown.

P-1
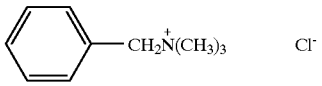
P-2
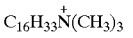
P-3
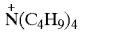
P-4
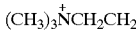
P-5
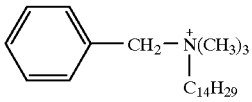
P-6
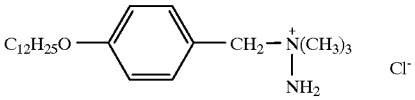
P-7
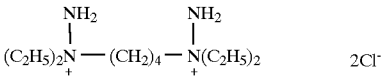
P-8
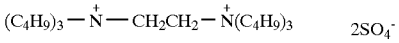
P-9
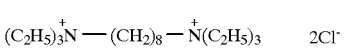
P-10
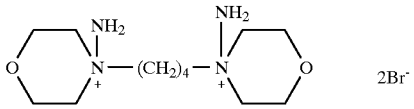
P-11
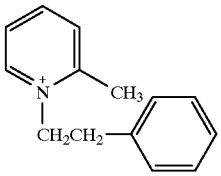
P-12
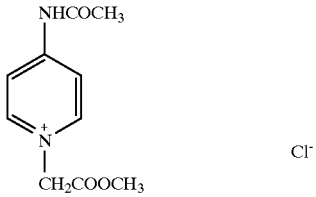
P-13
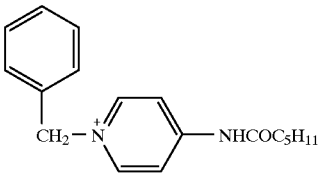
P-14
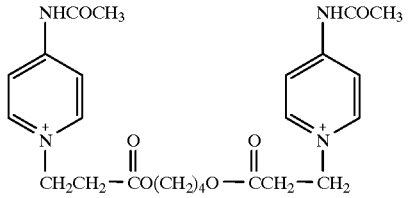
P-15
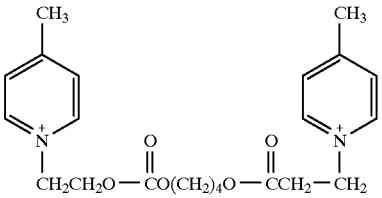
P-16
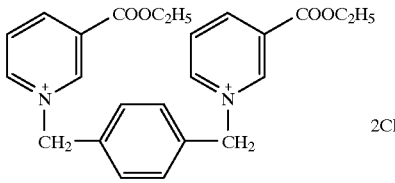
P-17
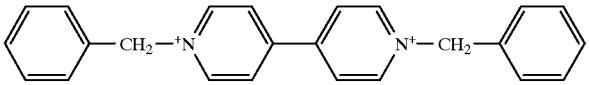
P-18
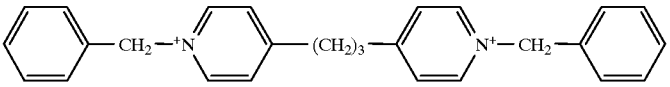
P-19
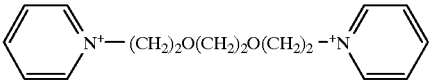
P-20
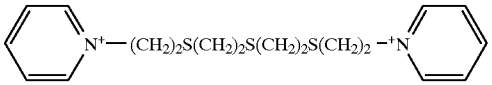

-continued
P-21
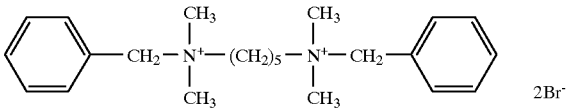
P-22
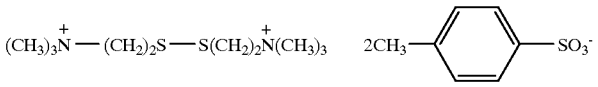
P-23
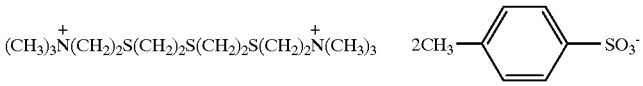
P-24
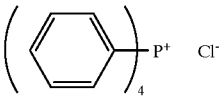
P-25
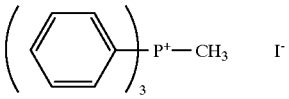
P-26
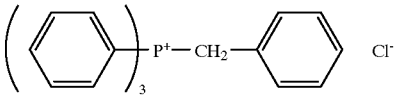
P-27
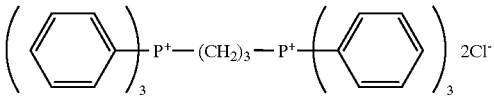
P-28
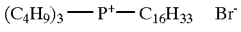
P-29
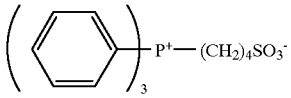
P-30
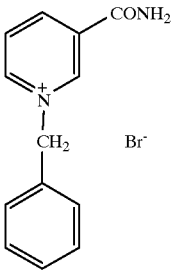
P-31
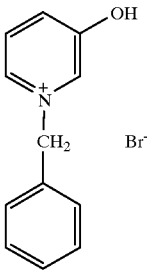
P-32
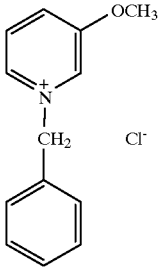
P-33
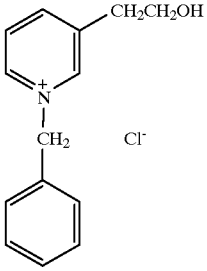
P-34
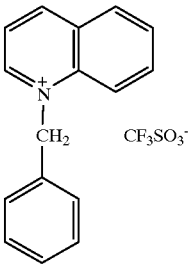
P-35
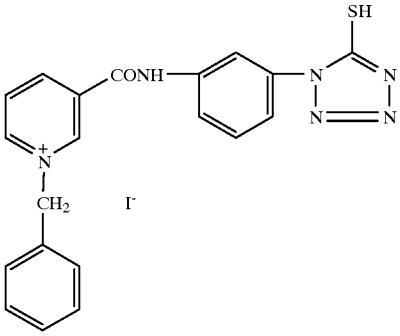

-continued
P-36
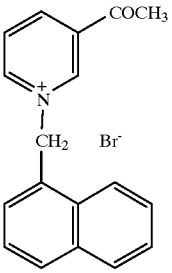
P-37
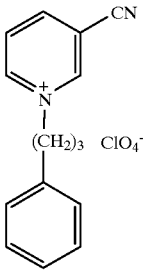
P-38
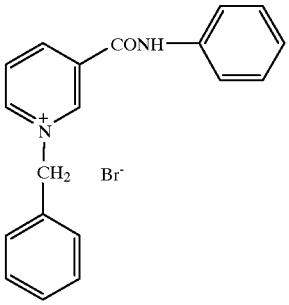
P-39
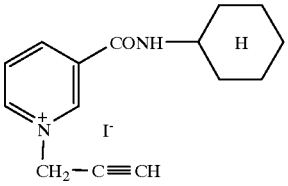
P-40
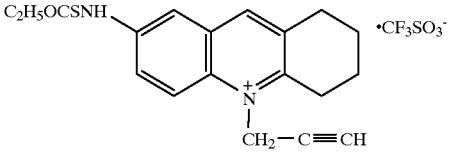
P-41
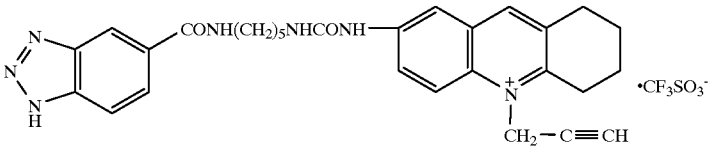
P-42
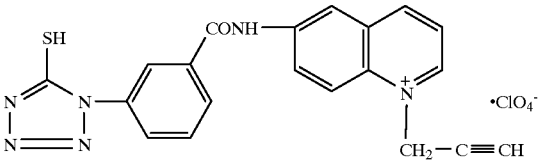
P-43
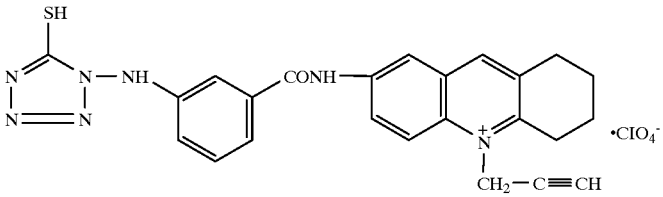
P-44
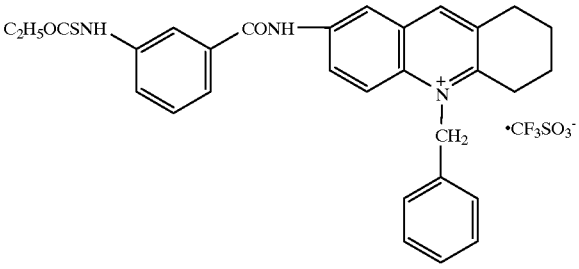
P-45
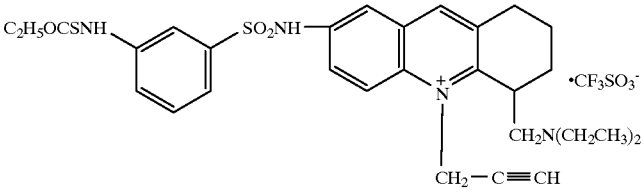

-continued
P-46
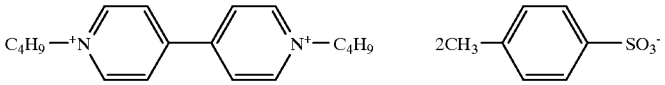
P-47
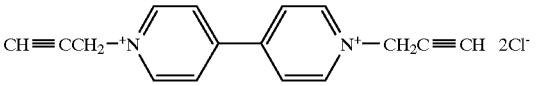
P-48
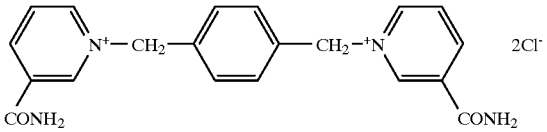
P-49
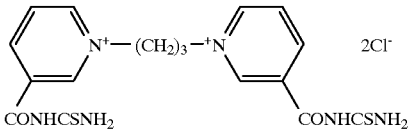
P-50
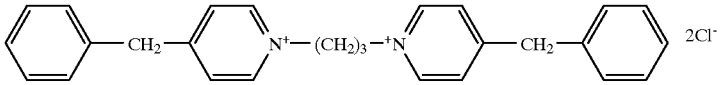
P-51
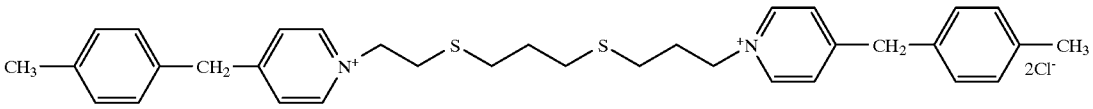
P-52
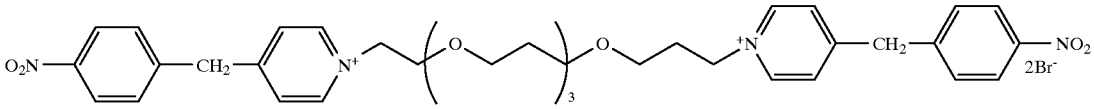
P-53
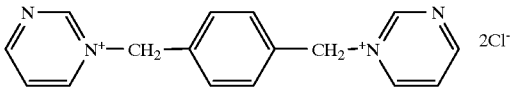
P-54
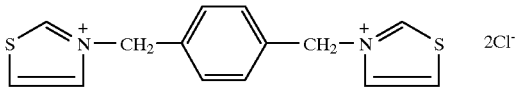
P-55
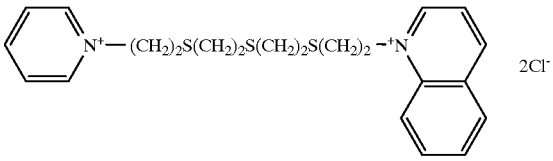

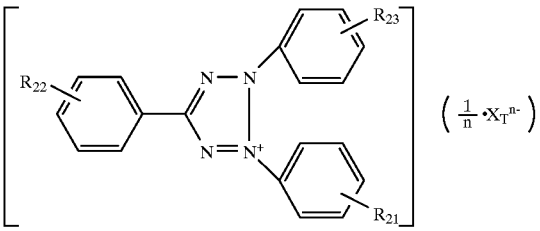

| Compound No. | $R_{21}$ | $R_{22}$ | $R_{23}$ | $X_\tau^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_5H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The above-mentioned quartenary onium compounds can be readily synthesized according to a method known in the art and for example, to the above-mentioned terazolium compounds, the method described in Chemical Review volume 55, pages 335 to 483 may be applied.

The added amount of the quaternary onium compound is between about $1\times10^{-8}$ and about 1 mole per mole of silver halide and preferably between $1\times10^{-7}$ and $1\times10^{-1}$ mole per mole of silver halide. These may be added to a light-sensitive material at an optional time during the formation of silver halide grains to coating.

The quaternary onium compounds may be employed individually or suitably in combination of two or more. These may be added to any of the layers constructing a light-sensitive material. However, they are preferably added to at least one of the layers having a silver halide emulsion layer and further, to the silver halide emulsion layer and/or its adjacent layer.

The halide composition of the silver halide emulsion employed in the light-sensitive material according to the present invention is preferably composed of silver chloride of 60 mole percent or more. More preferably there are employed the silver halide emulsion comprising silver chlorobromide containing silver chloride of 60 mole percent or sore, or silver chloroiodobromide containing silver chloride of 60 mole percent or more. The average grain diameter of silver halide is preferably not more than 0.5 $\mu$m and particularly preferably from 0.5 to 0.05 $\mu$m. The grain diameter described herein means the grain diameter of a spherical grain or a grain which can be approximated to a sphere. When a grain is cubic, the volume is converted to the sphere of which diameter is designated as the grain diameter. There is no limitation on the shape of the silver halide grain and there may be employed any of a tabular, spherical, cubic, tetradecahedral, regular octahedral shape and the like. The distribution of the grain size is preferably narrow and a so-called monodispersed emulsion is preferred in which 90% or preferably 95% of the total number of grains are included within grain size range of ±40% of the average grain size.

The silver halide emulsion comprises preferably at least one of metals selected from the VIII Group transition metals such as iridium, rhodium, ruthenium, osmium, etc., and rhenium, and these preferred are rhodium, ruthenium or osmium. Furthermore, in order to carry out an exposure employing a light source such as a laser beam, rhodium is preferably employed. The added amount of these transition metals ranges preferably from $10^{-10}$ to $10^{-2}$ mole per mole of silver halide and more preferably from $10^{-8}$ to $10^{-3}$ mole per mole of silver halide. Furthermore, during physical ripening and chemical ripening, metal salts of zinc, lead, thallium, rhenium, palladium, platinum, etc. may be present together.

The silver halide emulsion preferably undergoes chemical sensitization. As the chemical sensitizing method, there have been known sulfur sensitization, selenium sensitization, tellurium sensitization, reduction sensitization, and noble metal sensitization methods. These may be individually employed or in combination. The silver halide emulsion may be spectrally sensitized by a spectral sensitizer to a desired wavelength.

In order to prevent the formation of fog during production processes, storage and photographic processing, or stabilize photographic performances, various compounds known as an antifoggant and stabilizer may be added to the light-sensitive material according to the present invention. To a light-sensitive emulsion layer and/or a non-light-sensitive hydrophilic colloid layer, may be added inorganic or organic hardeners, coating aids, various surface active agents for various purposes such as the prevention of static charge formation, improvement in lubrication, emulsifying dispersion, prevention of adhesion, improvement in photographic characteristics, etc.

As a binder or protective colloid for photographic emulsion, gelatin is advantageously employed. However, in order to improve dimensional stability and the like, the photographic emulsion may comprise the dispersion of a synthetic polymer which is not soluble or hardly soluble in water.

The light-sensitive material according to the present invention comprises a support having preferably thereon at least one of an electrically conductive layer. As a representative method for preparing the electrically conductive layer, there are two methods, that is, one in which the layer is prepared employing a water-soluble electrically conductive polymer and a hydrophobic hardener, and the other in which the layer is prepared employing metal oxides. Regarding to these methods, a method described in Japanese Patent Publication Open to Public Inspection No. 3-265842 may be employed.

When the swelling ratio of a light-sensitive material processed according to the present invention is not more than 250% and more than 30%, and preferably not more than 180% and more than 50%, the advantages of the present invention may be further exhibited. The swelling percent described herein is that a light-sensitive material is incubated for three days at 38° C. and 50% relative humidity, the thickness (do) of the hydrophilic colloid layer is measured. The light-sensitive material is immersed in distilled water at 21° C. for three minutes and the thickness (d) of the hydrophilic colloid layer is measured again. The swelling ratio is then obtained employing the measured thickness according to (d−do)/d×100.

To the backing layer of the silver halide emulsion, compounds shown below may be incorporated employing various methods; various kinds of chemical sensitizers, toning agents, hardeners, surface active agents, thickening agents, plasticizers, development retarders, UV absorbers, antirradiation dyes, heavy metals, polymer latex.

A support employed for the light-sensitive material may be transparent or opaque. However, the transparent plastic support is preferably employed. The plastic supports include these composed of polyethylene compounds (for example, polyethylene terephthalate, polyethylene naphthalate, etc.), triacetate compounds (or example, triacetate cellulose, etc.), polyethylene compounds, etc. Of these, particularly preferably are supports (hereinafter referred to as SPS) composed of polyethylene terephthalate film and a stretched film comprised of styrene series polymers having a syndiotactic structure or compositions containing these styrene series polymers. The supports having a thickness of 50 to 250 $\mu$m are preferred and these having a thickness of 50 to 250 $\mu$m are particularly preferred.

In the present invention, the following compounds are preferably incorporated in the layers composing the silver halide photographic light-sensitive material.

(1) Compounds having acid radical

Compounds described in the left lower column 11th line of page 292 (8) to the right lower column third line of page 309 (25) of Japanese Patent Publication Open to Public Inspection No. 62-237445.

(2) Acidic polymers

Compounds described in page (10) [0036] to page (17) [0062] of Japanese Patent Publication Open to Public Inspection No. 6-186659.

(3) Sensitizing dyes Compounds described in page (3) [0017] to page (13) [0040] of Japanese Patent Publication Open to Public Inspection No. 5-224330.

Compounds described in page (11) [0042] to page (22) [0094] of Japanese Patent Publication Open to Public Inspection No. 6-194771.

Compounds described in page (2) [0015] to page (8) [0034] of Japanese Patent Publication Open to Public Inspection No. 6-242533.

Compounds described in page (3) [0012] to page (24) [0056] of Japanese Patent Publication Open to Public Inspection No. 6-337492.

Compounds described in page (4) [0013] to page (14) [0039] of Japanese Patent Publication Open to Public Inspection No. 6-337494.

(4) Supersensitizers

Compounds described in page (3) [0011] to page (16) [0066] of Japanese Patent Publication Open to Public Inspection No. 6-347938.

(5) Hydrazine derivatives and nucleation accelerating agents

Compounds described in page (8) [0028] to page (23) [0079] of Japanese Patent Publication Open to Public Inspection No. 7-128814.

(6) Redox compounds

Compounds described in page (7) 235 to page (22) 250 of Japanese Patent Publication Open to Public Inspection No. 4-245243.

As the above-mentioned compounds and other additives known in the art, there are provided compounds described in RD Nos. 17643 (December, 1978), 18716 (November, 1979), 308119 (December, 1989)

(Processing)

The advantages of the present invention is fully exhibited in a system in which a replenisher amount is markedly deceased in such a way that a fixer replenisher rate is not more 260 ml per $m^2$ of a light-sensitive material to be processed and further between 80 to 230 ml.

After a fixing step, the processing is followed by water wash and/or stabilizer bath. The purpose of the stabilizing bath is to stabilize an image after processing and the pH of a layer is adjusted (to pH from 3 to 8 after processing). For the adjustment of the pH, the stabilizing bath comprises preferably inorganic or organic acids or their salts, or alkali agents or their salts(for example, employed in combination with boric acid salts, metaboric acid salts, borax, phosphoric acid salts, carbonic acid salts, potassium hydroxide, sodium hydroxide, aqueous ammonia solution, monocarboxylic acids, dicarboxylic acids, polycarboxylic acids, citric acid, oxalic acid, maleic acid, acetic acid, etc.), aldehydes (for example, formalin, glyoxal, glutaraldehyde, etc.), chelating agents (for example, ethylenediamine tetraacetic acid or its metal salts, nitrilotriacetic acid salts, polyphosphoric acid salts, etc.), antiseptics (for example, phenol, 4-chlorophenol, cresol, o-phenylphenol, chlorophene, dichlorophene, formaldehyde, p-hydroxybenzoic acid ester, 2-(4-thiazoline)-benzoimidazole, benzoisothiazoline-3-on, dodecyl-benzyl-methylammonium-chloride, N-(fluorodichloromethylthio)phthalamide, 2,4,4'-trichloro-2'-hydroxydiphenyl ether, etc.), image tone control agents and/or dye-stain improving agents (for example, nitrogen-containing heterocyclic compounds having a mercapto group as a substituent; specific examples include 2-mercapto-5-sulfonic acid sodium-benzimidazole, 1-phenyl-5-mercaptotetrazole, 2-mercaptobenzthiazole, 2-mercapto-5-propyl-1,3,4-triazole, 2-mercaptohypochthanchin, etc.). Of these, the antiseptic is preferably incorporated in the stabilizing bath. These replenishers may be solution or solid. When solid is employed as a replenisher, the above-mentioned production method for solid state processing agents and method of these use can be employed.

In order to meet the requirement for the decrease in the amount of solution wastes, the amount of developer replenisher is not more than 300 ml per $m^2$ of a light-sensitive material and preferably between 30 and 200 ml. Further, the replenisher amount in the present invention means the amount of a solution to be replenished. Specifically, when the same solution as that of a mother developer or mother fixer is replenished, the replenisher amount is the amount of the mother solution; when a replenisher is prepared by diluting a concentrated developer or concentrated fixer with water, the replenisher amount is the total amount of each concentrated solution and water; when a replenisher is prepared by dissolving a solid developer or solid fixer in water, the replenisher amount is the total volume of the solid processing agent and water and when a solid developer or solid fixer and water are individually replenished, the replenisher amount is the total volume of each solid processing agent and water.

When replenishment is carried out employing a solid processing agent, it is preferred to show the total volume of the solid processing agent directly supplied to a processing tank in an automatic processor and water added separately. Furthermore, when the amount of a fixer replenisher is not more than 150 ml per $m^2$, the fixer replenisher is preferably a solution or solid processing agent having different compositions from these of the mother fixer in the tank of an automatic processor, and the amount of thiosulfate salt comprised in the fixer replenisher is preferably larger than that comprised in the mother fixer.

The solid processing agent described herein refers to a solid prepared with two or more of components composing a developing agent, and it is possible to employ one solid comprising all the developing components or two or more of solids capable of comprising all the developing components. In the solid processing agent, there may be one solid comprising at least two processing chemicals and besides chemicals contained in the solid, a single chemical may be employed. Preferred solid processing agents include powders prepared by a spray-dry production method, granules (average grain diameter of 0.1 to 10 mm, particularly, 90% of the grains before granulation are within ±40% of the average grain diameter.) prepared by a freeze-dry production method and granulation (extrusion granulation, running tank granulation, reversing granulation), tablets prepared by compression molding. The solid processing agent may comprise compounds such as a binding agent, a lubricant, etc. necessary for molding.

The temperature of developer, fixer, washing water and/or a stabilizer ranges preferably between 10 and 45° C. and each may be adjusted individually.

According to the requirement for the decrease in a processing time, when the processing is carried out employing an automatic processor, the total processing time (Dry to Dry) during the insertion of the leading edge of a film to the emergence from a drying zone is preferably not longer 50 seconds and more preferably from 20 to 45 seconds.

EXAMPLES

Example 1

(Preparation of support)

(Synthesis of SPS)

Reaction was carried out at 96° C. for 8 hours employing 200 weight parts of toluene, 100 weight parts of styrene, 65 g of triisobutyl aluminum and 234 g of pentamethylcyclopentadienyl titanium trimethoxide. After removing a catalyst by decomposition employing a sodium hydroxide methanol solution, washing with methanol was carried three times and 34 weight parts of the intended compound (SPS) was obtained.

(Preparation of SPS Film)

The resulting SPS was melt extruded from a T die at 330° C.; quickly chilled; solidified on a chilled drum, and an unstretched film was obtained. At the time, pulling out the chilled drum was carried out changing the peed two times. The unstretched film having a thickness of 1,054 μm was preheated at 135° C. After vertical stretching (3.1 times), horizontal stretching (3.4 times) was carried out at 130° C. Heat setting was then carried out at 250° C. Thus, a biaxially stretched film having a bending elastic modulus of 450 kg/mm$^2$ and a thickness of 100 μm was obtained as a support.

(Subbing coating on SPS Film)

After evaporating silica on both sides of the above-mentioned SPS film, a subbing layer was placed which was subjected to antistatic treatment comprising styrene-glycidylacrylate and fine particles of tin oxide.

(Preparation of Light-sensitive Material 1)

Employing a double-jet mixing method, monodispersed cubic silver chlorobromide grains were prepared which had a halide composition of 98 mole percent of silver chloride and 2 mole percent of silver bromide, and an average grain diameter of 0.15 μm. At the mixing, $7\times10^{-5}$ mole of $K_3Rh(H_2O)Br_5$ per mole of silver was added. Prior to a desalting process based on an ordinary method in which water-soluble salts were removed, 0.6 g of 4-hydroxy-6-methyl-1,3,3a,7-tetrazaindene (TAI) per mole of silver was added (otherwise indicated, thereunder, grams are per mole of silver.).

The resulting emulsion was heated to 60° C.; 0.75 mg of sodium thiosulfate was added; 600 mg of TAI was further added 60 minutes after the addition of TAI and the resulting emulsion was chilled to set.

Coating liquids were prepared by adding additives per m$^2$ according to the amounts described below, and was coated simultaneously on one side of the SPS support previously subbed in the order of an emulsion coating liquid, a lower protective layer liquid, and on the reverse side a backing coating liquid.

| | |
|---|---|
| (Emulsion Coating Liquid) | |
| NaOH 0.5N solution | 4.39 ml/m$^2$ |
| Compound A | 6.53 g/m$^2$ |
| Quaternary onium compound | amount described in Table 2 |
| Kiraya saponin | 107 mg/m$^2$ |
| Compound B | 18.5 mg/m$^2$ |
| Compound C | 9.8 mg/m$^2$ |
| Gelatin latex | 480 mg/m$^2$ |
| Sodium polystyrenesulfonate | 52.2 mg/m$^2$ |
| Colloidal silica | 20 mg/m$^2$ |
| (Lower Protective Layer Liquid) | |
| Gelatin | 0.5 g/m$^2$ |
| Solid dispersion of Dye D (average grain diameter 0.1 μm) | 62.0 mg/m$^2$ |
| Citric acid | 4.1 mg/m$^2$ |
| Formalin | 1.2 mg/m$^2$ |
| Hardener: K-1 | 0.6 mg/m$^2$ |
| Sodium polystyrenesulfonate | 11.0 mg/m$^2$ |
| (Upper Protective Layer Liquid) | |
| Gelatin | 0.3 g/m$^2$ |
| Compound E | 18.0 mg/m$^2$ |
| Dye F | 48.4 mg/m$^2$ |
| Compound G | 105.0 mg/m$^2$ |
| Compound H | 1.25 mg/m$^2$ |
| Amorphous silica (average grain diameter 1.63 μm) | 15.0 mg/m$^2$ |
| Amorphous silica (average grain diameter 3.5 μm) | 21.0 mg/m$^2$ |

-continued

| | |
|---|---|
| Citric acid | 4.5 mg/m$^2$ |
| Sodium polystyrenesulfonate | 11.0 mg/m$^2$ |
| Formalin in in-line addition | 10 mg/m$^2$ |
| (Backing Coating Liquid) | |
| Compound I | 170 mg/m$^2$ |
| Dye J | 30 mg/m$^2$ |
| Compound K | 45 mg/m$^2$ |
| Compound L | 10 mg/m$^2$ |
| Kiraya saponin | 111 mg/m$^2$ |
| Compound M | 200 mg/m$^2$ |
| Colloidal silica | 200 mg/m$^2$ |
| Compound N | 35 mg/m$^2$ |
| Compound O | 31 mg/m$^2$ |
| Compound P | 3.1 mg |
| Polymethylmethacrylic acid polymer (average grain diameter 5.6 $\mu$m) | 28.9 mg/m$^2$ |
| Glyoxal | 10.1 mg/m$^2$ |
| Citric acid | 9.3 mg/m$^2$ |
| Sodium polystyrenesulfonate | 71.1 mg/m$^2$ |
| Followings were added in in-line. | |
| Compound Q | 81 mg/m$^2$ |
| Compound R | 88.2 mg/m$^2$ |
| Calcium acetate | 3.0 mg/m$^2$ |
| Hardener: K-1 | 10 mg/m$^2$ |

Compound A

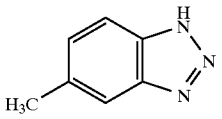

Compound B

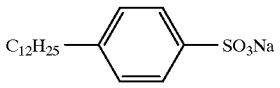

Compound C

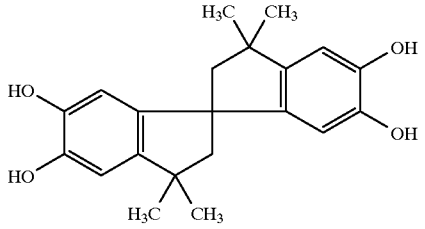

Compound D

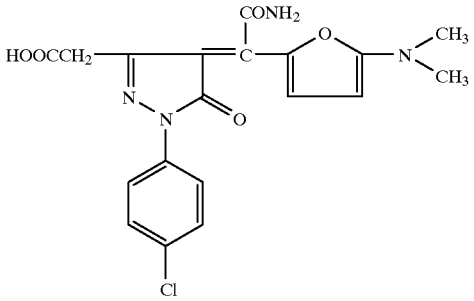

Compound E

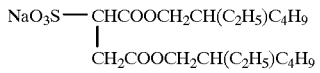

Compound F

-continued
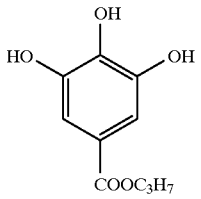
Compound G
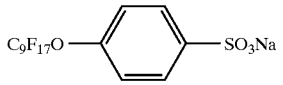
Compound H
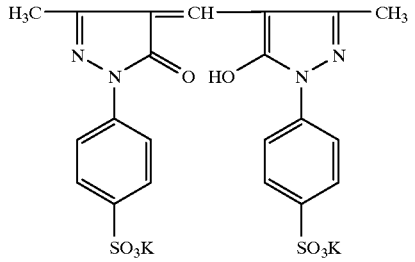
Compound I
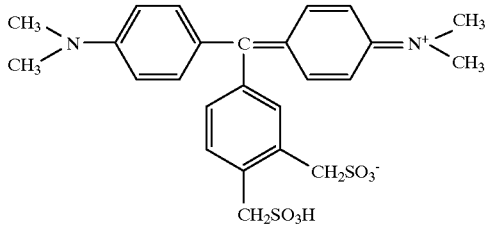
Compound J
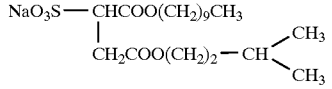
Compound K
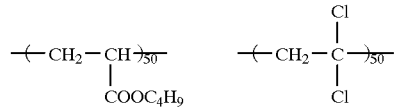
Compound L
$H\text{-}(OCH_2CH_2)_n\text{-}OH$ n = 34.6
Compound M
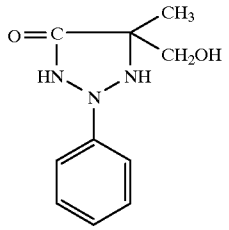
Compound N
$HOCH_2SO_3Na$
Compound O
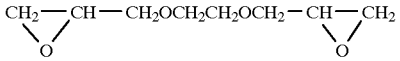
Compound P
$(CH_2{=}CHSO_2CH_2)_4C$
Gelatin latex -continued

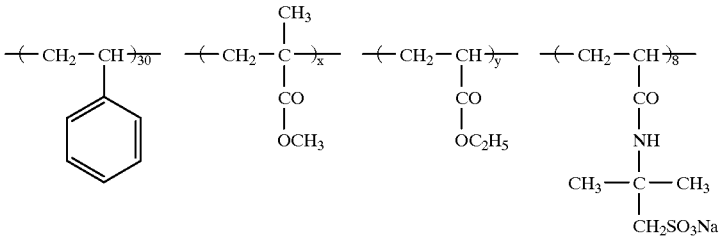

Gelatin: Latex = 5:1, x + Y = 62

However, coating was uniformly carried out so that the coated amounts of the emulsion layer were 2.0 g/m$^2$ of Ag and 1.2 g/m$^2$ of gelatin, and the coated amount of the backing layer was 2.1 g/m$^2$ of gelatin.

(Preparation of Processing Agents)

(Preparation of Solid Processing Agent A)

In a bantam mill manufactured by Hosokawa Micron Co. 0.6 g of 8-mercaptoadenine and 5.5 g of 5-methylbenzotriazole were pulverized until the average grain diameter reached 10 $\mu$m. The resulting grains were added with 600 g of sodium erythorbate monohydrate, 24.4 g of 1-phenyl-4-hydroxymethyl-4-methyl-3-prazolidone (dimezone S) and 120 g of sodium metabisulfite, and the resulting mixture was mixed in the mill for 30 minutes. The resulting mixture was then granulated by a commercially available stirring granulator upon adding 20 ml of deionized water and an aqueous D-sorbit solution (64 weight percent) and the resulting granules were heated at 50° C. for about one hour and a half employing a fluidized-bed dryer. Thus granules (referred to as DAK) of which water content ratio was 1% or less were prepared.

The obtained DAK was classified into 1 mm mesh by a commercially available sizer in a room conditioned at 25° C. and 40% relative humidity or less, and the resulting granules were mixed with 8.1 g of sodium hexanesulfonate for 3 minutes in a commercially available cross-rotary mixer. Thereafter, the resulting mixture was compress tableted employing the tablet machine, a modified Tough Press Collect HU manufactured Kikusui Seisakusho Co. Ltd., so as to form each tablet having a weight of 10.2 g. The prepared tablets were designated DA.

(Preparation of Solid Processing Agent B)

Potassium carbonate and potassium bromide were pulverized in the bantam mill (mentioned above) until the average grain diameter reached 10 $\mu$m.

An aqueous solution a was prepared by dissolving 0.5 g of $LiOH.H_2O$ and 0.4 g of 1-phenyl-5-tetrazole in 21 ml of deionized water.

A mixture consisting of 40 g of diethylenetriaminepentaacetic acid (DTPA.5H) 20 g of the above-mentioned pulverized potassium bromide, 60 g of mannitol, 30 g of sorbitol and 552 g of the above-mentioned pulverized potassium carbonate was mixed in the bantam mill (mentioned above) for 30 minutes and was granulated for about 5 minutes upon adding 4 ml of deionized water and the aqueous solution a employing a commercially available stirring granulator. Thereafter, the granules were dried at 60° C. employing a fluidized-bed dryer until the water content ratio reached 2% or less. Thus granules (referred to as DBK) were obtained.

The obtained DBK was classified into 1 mm mesh employing a commercially available sizer in a room conditioned at 25° C. and 40% relative humidity or less. The resulting granules were mixed with 7 g of sodium hexanesulfonate for 3 minutes employing a commercially available cross-rotary mixer. Thereafter, the resulting mixture was compress tableted by the tablet machine (mentioned above) so as to obtain each tablet having a weight of 13.7 g. Thus the tablets DB were prepared.

(Preparation of Developer)

In deionized water, 81 tablets of prepared solid processing agent A and 53 tablets of the prepared solid processing agent B were dissolved, and 10 liters of the solution was made, which was employed as a processing starter and a replenisher.

(Preparation of Fixer and Fixer Replenisher)

Salt concentration was adjusted employing sodium chloride which had no effect on fixing properties, and the fixer having the following formula was prepared.

| | |
|---|---|
| Ammonium thiosulfate | 1.0 mole/l |
| Deionized water | 242 g/l |
| Sodium sulfite | 22 g/l |
| Boric acid | 9.78 g/l |
| Sodium acetate.trihydrate | 32.27 g/l |
| Acetic acid 90% aqueous solution | 16.27 g/l |
| Tartaric acid | 3 g/l |
| Aluminum sulfate 27% aqueous solution | 32.93 g/l |
| Sodium chloride | amount to obtain salt concentration described in Table 1 |
| Sulfuric acid 50% aqueous solution | amount to adjust pH |
| pH | 4.70 |
| Water to make | 1 liter |

(Processing)

The prepared Light-sensitive Material 1 was cut into a full size. Employing the automatic processor (Automatic Processor (1)) according to the present invention shown in FIG. 1 and the comparative automatic processor (Automatic Processor (2)) having a conventional structure shown in FIG. 3, and the prepared processing solution, running processing was carried out under the processing conditions described below at the rate of 1,000 sheets of full size material per day in which the ratio of exposed materials to these unexposed was 8 to 2.

| | Temperature (° C.) | Time (second) | Replenisher Rate (ml/m$^2$) |
|---|---|---|---|
| Development | 35 | 15 | 110 |
| Fix | 35 | 11 | shown in Table 1 |
| Wash | room temperature | 6 | |
| Drying | 50 | 11 | |

Note: tap water was used for wash, while replenishing 3 1/minute.

(Evaluation)

Processed films were visually inspected and the number of the film having no stain was confirmed in comparison. Table 1 shows the results.

TABLE 1

| No. | Salt Concentration (mole/l) | Fixer Replenisher Rate (ml/m$^2$) | Automatic processor No. | Stained Film Number | Note |
|---|---|---|---|---|---|
| 1 | 1.78 | 280 | 1 | >30000 | Comparative |
| 2 | 1.78 | 260 | 1 | >30000 | Present invention |
| 3 | 1.78 | 250 | 1 | >30000 | Present invention |
| 4 | 1.9 | 280 | 1 | 28015 | Comparative |
| 5 | 1.9 | 260 | 1 | 27035 | Present invention |
| 6 | 1.9 | 250 | 1 | 27008 | Present invention |
| 7 | 1.95 | 280 | 1 | 27022 | Comparative |
| 8 | 1.95 | 260 | 1 | 4030 | Comparative |
| 9 | 1.95 | 250 | 1 | 3003 | Comparative |
| 10 | 1.78 | 280 | 2 | >30000 | Comparative |
| 11 | 1.78 | 260 | 2 | 6334 | Comparative |
| 12 | 1.9 | 260 | 2 | 5007 | Comparative |
| 13 | 1.95 | 280 | 2 | 25076 | Comparative |
| 14 | 1.95 | 260 | 2 | 4017 | Comparative |

Table 2 shows the results.

TABLE 2

| No. | Tartaric Acid (g/l) | Boric Acid (g/l) | Sodium Gluconate (g/l) | Fixer Replenisher Rate (ml/m$^2$) | Automatic Processor No. | Stained Film Number | Note |
|---|---|---|---|---|---|---|---|
| 1 | 3 | 9.78 | 0 | 250 | 1 | 27014 | Present invention |
| 2 | 0 | 9.78 | 0 | 250 | 1 | 24733 | Present invention |
| 3 | 0 | 9.78 | 3 | 250 | 1 | 27007 | Present invention |
| 4 | 0 | 0 | 0 | 250 | 1 | 28131 | Present invention |
| 5 | 3 | 0 | 3 | 250 | 1 | >30000 | Present invention |
| 6 | 3 | 9.78 | 0 | 250 | 2 | 4029 | Comparative |
| 7 | 0 | 9.78 | 0 | 250 | 2 | 3720 | Comparative |
| 8 | 0 | 9.78 | 3 | 250 | 2 | 4008 | Comparative |
| 9 | 0 | 0 | 0 | 250 | 2 | 4381 | Comparative |

Example 2

Evaluation was carried our in the same manner as for Example 1, except that the formula of the fixer and fixer replenisher described below was employed.

| | |
|---|---|
| Ammonium thiosulfate | 1.0 mole/l |
| Deionized water | 242 g/l |
| Sodium sulfite | 22 g/l |
| Boric acid | amount shown in Table 2 |
| Sodium acetate.trihydrate | 32.27 g/l |
| Acetic acid 90% aqueous solution | 16.27 g/l |
| Tartaric acid | amount shown in Table 2 |
| Sodium gluconate | amount shown in Table 2 |
| Aluminum sulfate 27% aqueous solution | 32.93 g/l |
| Sodium chloride | amount to make salt concentration of 1.90 mole/l |
| Sulfuric acid 50% aqueous solution | amount to adjust pH |
| Sodium hydroxide | amount to adjust pH |
| pH | 4.70 |
| Water to make | 1 liter |

Example 3

Evaluation was carried our in the same manner as for Example 1, except that the formula of the fixer and fixer replenisher described below was employed.

| | |
|---|---|
| Ammonium thiosulfate | 1.0 mole/l |
| Deionized water | 242 g/l |
| Sodium sulfite | 22 g/l |
| Boric acid | 9.78 g/l |
| Sodium acetate.trihydrate | 32.27 g/l |
| Acetic acid 90% aqueous solution | 16.27 g/l |
| Tartaric acid | 3 g/l |
| Aluminum sulfate 27% aqueous solution | 32.93 g/l |
| Sodium chloride amount to make salt concentration of | 1.9 mole/l |
| Sulfuric acid 50% aqueous solution | amount to adjust pH |
| Sodium hydroxide | amount to adjust pH |
| Compound described in Table 3 | amount shown in Table 3 |
| pH | 4.70 |
| Water to make | 1 liter |

Table 3 shows the results.

TABLE 3

| No. | Polyalkylene-oxide polyethylene glycol 4000 (g/l) | Compound Represented by General Formula (1) D-mannitol (g/l) | D-sorbitol (g/l) | Compound Represented by General Formula (2) (g/l) Sodium 1-octane-sulfonate | Sodium hexane-sulfonate | Fixer Replenisher Rate (ml/m$^2$) | Automatic processor No. | Stained film Number | Note |
|---|---|---|---|---|---|---|---|---|---|
| 1 | 0 | 0 | 0 | 0 | 0 | 280 | 1 | 27037 | Comp. |
| 2 | 0 | 0 | 0 | 0 | 0 | 260 | 1 | 27012 | Inv. |
| 3 | 0 | 5 | 0 | 0 | 0 | 260 | 1 | 28010 | Inv. |
| 4 | 0 | 10 | 0 | 0 | 0 | 260 | 1 | 28093 | Inv. |
| 5 | 0 | 0 | 5 | 0 | 0 | 260 | 1 | 28000 | Inv. |
| 6 | 0 | 0 | 10 | 0 | 0 | 260 | 1 | 28009 | Inv. |

TABLE 3-continued

| No. | Polyalkylene-oxide polyethylene glycol 4000 (g/l) | Compound Represented by General Formula (1) D-mannitol (g/l) | D-sorbitol (g/l) | Compound Represented by General Formula (2) (g/l) Sodium 1-octane-sulfonate | Sodium hexane-sulfonate | Fixer Replen-isher Rate (ml/m$^2$) | Auto-matic pro-cessor No. | Stained film Number | Note |
|---|---|---|---|---|---|---|---|---|---|
| 7 | 0 | 0 | 0 | 1 | 0 | 260 | 1 | 29000 | Inv. |
| 8 | 0 | 0 | 0 | 3 | 0 | 260 | 1 | over 30000 | Inv. |
| 9 | 0 | 0 | 0 | 0 | 1 | 260 | 1 | 29011 | Inv. |
| 10 | 0 | 0 | 0 | 0 | 3 | 260 | 1 | over 30000 | Inv. |
| 11 | 0 | 5 | 5 | 0 | 0 | 260 | 1 | 29081 | Inv. |
| 12 | 0 | 0 | 0 | 1 | 1 | 260 | 1 | over 30000 | Inv. |
| 13 | 1.5 | 0 | 0 | 0 | 0 | 260 | 1 | 27824 | Inv. |
| 14 | 1.5 | 5 | 5 | 1 | 1 | 260 | 1 | over 30000 | Inv. |
| 15 | 0 | 0 | 0 | 0 | 0 | 280 | 2 | 25011 | Comp. |
| 16 | 0 | 0 | 0 | 0 | 0 | 260 | 2 | 3105 | Comp. |
| 17 | 0 | 5 | 0 | 0 | 0 | 260 | 2 | 4092 | Comp. |
| 18 | 0 | 0 | 5 | 0 | 0 | 260 | 2 | 4033 | Comp. |
| 19 | 0 | 0 | 0 | 1 | 0 | 260 | 2 | 4574 | Comp. |
| 20 | 0 | 0 | 0 | 0 | 1 | 260 | 2 | 4590 | Comp. |
| 21 | 1.5 | 0 | 0 | 0 | 0 | 260 | 2 | 3019 | Comp. |
| 22 | 0 | 5 | 5 | 0 | 0 | 260 | 2 | 5026 | Comp. |
| 23 | 1.5 | 5 | 5 | 1 | 1 | 260 | 2 | 5868 | Comp. |

Inv.: Present Invention Comp.: Comparative

Example 4

(Preparation of Light-sensitive Material 2)

(Preparation of Silver Halide Emulsion A)

Employing a double-jet mixing method, silver chlorobromide core grains composed of 70 mole percent of silver chloride and 30 mole percent of silver bromide were prepared which had an average thickness of 0.05 μm and an average grain diameter of 0.15 μm. At the mixing of core grains, $8\times10^{-7}$ mole of $K_3RuCl_6$ per mole of silver was added. Shells were attached to the core grains with the use of the double-jet mixing method. At the time, $3\times10^{-7}$ mole of $K_2IrCl_6$ per mole of silver was added. The obtained emulsion was of a tabular grain silver chloroiodobromide (90 mole percent of silver chloride, 0.2 mole percent of silver iodide, and 9.8 mole percent of silver bromide) emulsion having, as a main plane, a (100) plane of core/shell type mono-dispersion (variation coefficient 10%) having an average thickness of 0.10 μm and an average grain diameter of 0.25 μm. Thereafter, salts were removed employing modified gelatin G-8 (amino group in gelatin is substituted with phenylcarbamyl) described in page 287 (3) of Japanese Patent Publication Open to Public Inspection No. 2-280139. The EAg after the removal of salts was 190 mV.

To the resulting emulsion, $1\times10^{-3}$ mole of 4-hydroxy-6-methyl-1,3,3a,7-tetrazaindene per mole of silver was added. Furthermore, potassium bromide and citric acid were added to adjust the pH to 5.6 and EAg at 123 mV. Thereafter, $2\times10^{-5}$ mole of chloroauric acid was added and $3\times10^{-6}$ of inorganic sulfur was then added, and chemical ripening was carried out at 60° C. until the maximum sensitivity was obtained. After finishing the ripening, there were added $2\times10^{-3}$ mole of 4-hydroxy-6-methyl-1,3,3a,7-tetrazaindene, $3\times10^{-4}$ mole of 1-phenyl-5-mercaptotetrazole per mole of silver, and gelatin.

(Preparation of Silver Halide Emulsion B)

Employing a double-jet mixing method, silver chloroiodobromide core grains composed of 60 mole percent of silver chloride, 37.5 mole percent of silver bromide and 2.5 mole percent of silver iodide were prepared which had an average thickness of 0.05 μm and an average grain diameter of 0.15 μm. At the mixing of core grains, $2\times10^{-8}$ mole of $K_3Rh(H_2O)Br_5$ per mole of silver was added. Shells were attached to the core grains with the use of the double-jet mixing method. At the time, $3\times10^{-7}$ mole of $K_2IrCl_6$ per mole of silver was added. The obtained emulsion was of a tabular grain silver chloroiodobromide (90 mole percent of silver chloride, 0.5 mole percent of silver iodide, and 9.5 mole percent of silver bromide) emulsion having core/shell type mono-dispersion (variation coefficient 10%) having an average thickness of 0.10 gm and an average grain diameter of 0.42 μm. Subsequently, salts were removed employing modified gelatin G-8 (mentioned above). The EAg after the removal of salts was 190 mV.

To the resulting emulsion, $1\times10^{-3}$ mole of 4-hydroxy-6-methyl-1,3,3a,7-tetrazaindene per mole of silver was added. Furthermore, potassium bromide and citric acid were added to adjust the pH to 5.6 and EAg to 123 mV. Thereafter, $2\times10^{-5}$ mole of chloroauric acid was added and $3\times10^{-5}$ of N,N,N'-trimethyl-N'-heptafluoroselenourea was then added, and chemical ripening was carried out at 60° C. until the maximum sensitivity was obtained. After finishing the ripening, there were added $2\times10^{-3}$ mole of 4-hydroxy-6-methyl-1,3,3a,7-tetrazaindene, $3\times10^{-4}$ mole of 1-phenyl-5-mercaptotetrazole per mole of silver and gelatin.

(Preparation of Silver Halide Photographic Light-Sensitive Material 2 for Printing Plate-making Scanner for He—Ne-laser Beam)

On the subbing layer of one side of a support similar to that in Example 1, the gelatin subbing layer of Formula 1, the silver halide emulsion layer 1 of Formula 2, inter-protective layer of Formula 3, silver halide emulsion layer 2 of Formula 4 and protective layer of Formula 5 described below were simultaneously coated in this order so as to obtain the coated amounts of gelatin of 0.5 g/m$^2$ in the subbing layer, silver of 1.5 g/m$^2$ and gelatin of 0.5 g/m$^2$ in the emulsion layer 1, gelatin of 0.3 g/m$^2$ in the interlayer, silver of 1.4 g/m$^2$ and gelatin of 0.4 g/m$^2$ in the emulsion layer 2 and gelatin of 0.3 g/m$^2$ in the protective layer. Furthermore, on the subbing layer of the other side of the support, the hydrophobic polymer layer of Formula 7 and the backing protective layer of Formula 8 described below were simultaneously coated at the same tome of the emulsion side coating in this order so as to obtain the coated amounts of 0.6 g/m$^2$ in the hydrophobic polymer layer and gelatin of 0.4 g/m$^2$ of the backing protective layer.

| | |
|---|---|
| Formula 1 (Composition of Gelatin Subbing Layer) | |
| Gelatin | 0.5 g/m$^2$ |
| Solid dispersed fine particles of Dye AD-1 (average particle diameter 0.1$\mu$m) | 25 mg/m$^2$ |
| Sodium polystyrenesulfonate | 10 mg/m$^2$ |
| S-1 (sodium iso-amyl-n-Decylsulfosuccinate | 0.4 mg/m$^2$ |
| Formula 2 (Composition of Silver Halide Emulsion Layer 1) | |
| Silver halide emulsion A | in Ag 1.5 g/m$^2$ |
| Solid dispersed fine particles of Dye AD-8 (average particle diameter of 0.1 $\mu$m) | 20 mg/m$^2$ |
| Cyclodextrin (hydrophilic polymer) | 0.5 g/m$^2$ |
| Sensitizing dye d-1 | 5 mg/m$^2$ |
| Sensitizing dye d-2 | 5 mg/m$^2$ |
| Hydrazine derivative H-7 | 20 mg/m$^2$ |
| Redox compound: RE-1 | 20 mg/m$^2$ |
| Compound e | 100 mg/m$^2$ |
| Latex polymer f | 0.5 g/m$^2$ |
| Hardener g | 5 mg/m$^2$ |
| S-1 | 0.7 g/mm$^2$ |
| 2-Mercapto-6-hydoxypurine | 5 mg/m$^2$ |
| Ethylenediaminetetraacetic acid (EDTA) | 30 mg/m$^2$ |
| Colloidal silica (average particle diameter of 0.05 $\mu$m) | 10 mg/m$^2$ |
| Formula 3 (Composition of Interlayer) | |
| Gelatin | 0.3 g/m$^2$ |
| S-1 | 2 mg/m$^2$ |
| Formula 4 (Composition of Silver Halide Emulsion Layer 2) | |
| Silver Halide Emulsion B in Ag amount | 1.4 g/m$^2$ |
| Sensitizing dye d-1 | 3 mg/m$^2$ |
| Sensitizing dye d-2 | 3 mg/m$^2$ |
| Hydrazine derivative H-20 | 20 mg/m$^2$ |
| Nucleation accelerating agent: exemplified compound Nb-12 | 40 mg/m$^2$ |
| Redox compound: RE-2 | 20 mg/m$^2$ |
| 2-mercapto-6-hydroxypurine | 5 mg/m$^2$ |
| EDTA | 20 mg/m$^2$ |
| Latex polymer f | 0.5 g/m$^2$ |
| S-1 | 1.7 mg/m$^2$ |
| Formula 5 (Composition of Emulsion protective Layer) | |
| Gelatin | 0.6 g/m$^2$ |
| Solid dispersion of Dye AD-5 (average particle diameter of 0.1 $\mu$m) | 40 mg/m$^2$ |
| S-1 | 12 mg/m$^2$ |
| Matting agent: monodispersed silica of average particle diameter of 3.5 $\mu$m | 25 mg/m$^2$ |
| Nucleation accelerating agent: exemplified compound Na-3 | 40 mg/m$^2$ |
| 1,3-vinylsulfonyl-2-propanol | 40 mg/m$^2$ |
| Surface active agent | 1 mg/m$^2$ |
| Colloidal silica (average particle diameter of 0.05 $\mu$m) | 10 mg/m$^2$ |
| Hardener: K-1 | 30 mg/m$^2$ |
| Formula 6 (Composition of Backing Layer) | |
| Gelatin | 0.6 g/m$^2$ |
| S-1 | 5 mg/m$^2$ |
| Latex polymer f | 0.3 g/m$^2$ |
| Colloidal silica (average particle diameter of 0.05 $\mu$m) | 70 mg/m$^2$ |
| Sodium polystyrenesulfonate | 20 mg/m$^2$ |
| Compound i | 100 mg/m$^2$ |
| Formula 7 (Composition of Hydrophobic Polymer Layer) | |
| Latex (methylmethacrylate:acrylic acid = 97:3) | 1.0 g/m$^2$ |
| Hardener g | 6 mg/m$^2$ |
| Formula 8 (Backing Protective Layer) | |
| Gelatin | 0.4 g/m$^2$ |
| Matting agent: monodispersed polymethylmethacrylate having an average grain diameter of 5 $\mu$m) | 50 mg/m$^2$ |
| Sodium d-(2-ethylhexyl)-sulfosuccinate | 10 mg/m$^2$ |
| Surface active agent h | 1 mg/m$^2$ |
| Dye k | 20 mg/m$^2$ |
| $H—(OCH_2CH_2)_{68}—OH$ | 50 mg/m$^2$ |
| Hardener: K-1 | 20 mg/m$^2$ |

-continued
Compound i
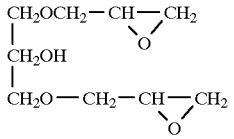
Dye k
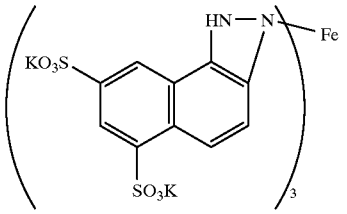
RE-1
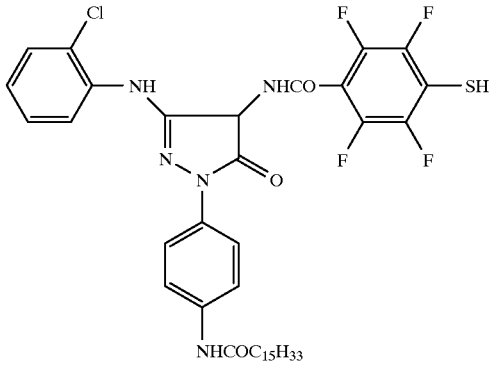
RE-2
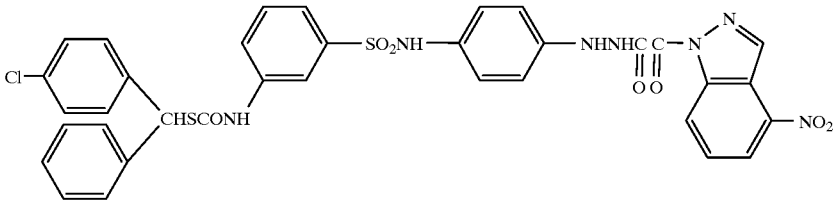
K-1
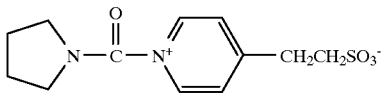
Sensitizing dye d-1
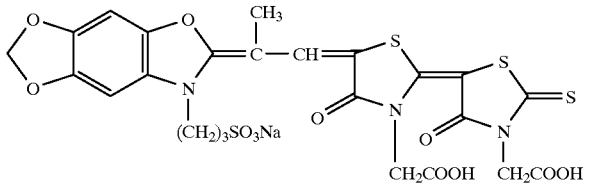

-continued
Sensitizing dye d-2
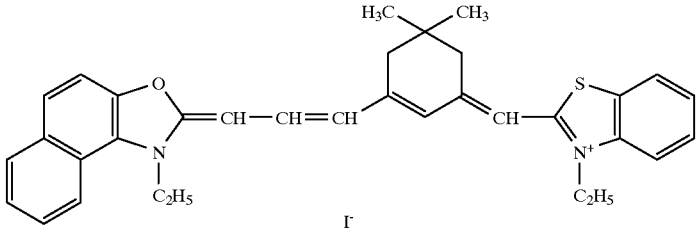
Compound e
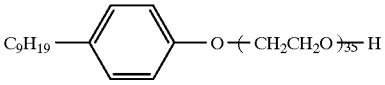
Latex polymer f
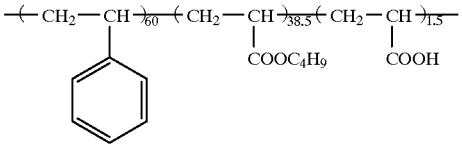
Hardener g
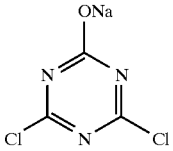
Surface Active Agent h
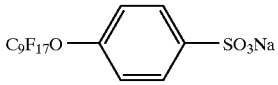
AD-1
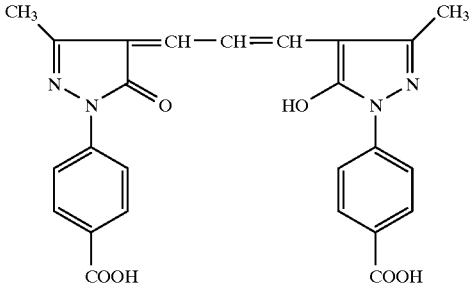
AD-5
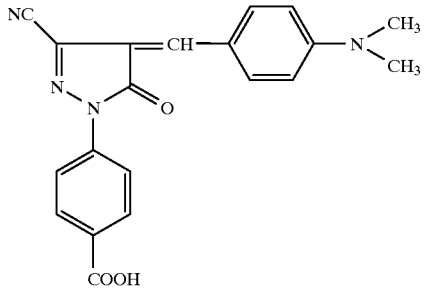

-continued

AD-8

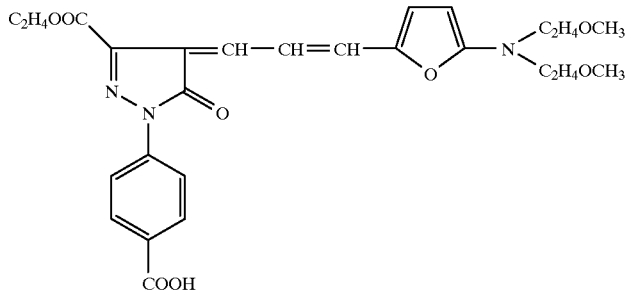

Further, after coating and drying, the surface resistivity of the backing side was $6\times10^{11}$ at 23° C. and 20% relative humidity, and the pH and degree of swelling of the layer surface of the emulsion side were 5.5 and 175, respectively.

(Development Starter and Replenisher)

As the development starter, a commercially available CDM-681 manufactured by Konica Corp. was employed and a development replenisher was prepared according to the formula described below.

| | |
|---|---|
| Deionized water | 344 g/l |
| DTPA 40% aqueous solution | 10.35 g/l |
| Sodium sulfite | 60.86 g/l |
| Potassium sulfite 55.5% aqueous solution | 7.53 g/l |
| Potassium bromide | 1.9 g/l |
| Potassium carbonate 49% aqueous solution | 106.59 g/l |
| 8-Mercaptoadenine | 0.19 g/l |
| Diethylene glycol | 38 g/l |
| Hydroquinone | 22.8 g/l |
| Sodium erythorbate monohydrate | 1.9 g/l |
| Benzotriazole | 0.25 g/l |
| Dimezone S | 1.24 g/l |
| 1-Phenyl-5-mercaptotetrazole | 0.08 g/l |
| Potassium hydroxide 48.6% aqueous solution | amount to adjust pH |
| pH | 10.60 |
| Water | to make 1 liter |

(Fixer and Fixer Replenisher)

The fixer and fixer replenisher were prepared in the same manner as for Example 1.

(Processing and Evaluation)

Processing and evaluation were carried out in the same manner as for Example 1, except that the Light-sensitive Material 2 was cut into full size, and the processing amount was changed to 100 sheets per day and the processing condition was changed to these described below.

| | Temperature (° C.) | Time (second) | Replenisher Rate (ml/m$^2$) |
|---|---|---|---|
| Development | 35 | 30 | 145 |
| Fix | 35 | 20 | shown in Table 4 |
| Wash | room temperature | 20 | |
| Drying | 50 | 20 | |

Table 4 shows the results.

TABLE 4

| No. | Salt Concentration (mole/l) | Fixer Replenisher Rate (ml/m$^2$) | Automatic processor No. | Stained Film Number | Note |
|---|---|---|---|---|---|
| 1 | 1.78 | 280 | 1 | >20000 | Comparative |
| 2 | 1.78 | 260 | 1 | >20000 | Present invention |
| 3 | 1.78 | 200 | 1 | 18021 | Present invention |
| 4 | 1.9 | 280 | 1 | >20000 | Comparative |
| 5 | 1.9 | 260 | 1 | 19034 | Present invention |
| 6 | 1.9 | 200 | 1 | 18003 | Present invention |
| 7 | 1.95 | 280 | 1 | 18055 | Comparative |
| 8 | 1.95 | 260 | 1 | 2411 | Comparative |
| 9 | 1.95 | 200 | 1 | 1038 | Comparative |
| 10 | 1.78 | 280 | 2 | >20000 | Comparative |
| 11 | 1.78 | 260 | 2 | 3282 | Comparative |
| 12 | 1.78 | 200 | 2 | 2251 | Comparative |
| 13 | 1.9 | 200 | 2 | 3063 | Comparative |
| 14 | 1.95 | 280 | 2 | 16245 | Comparative |
| 15 | 1.95 | 260 | 2 | 1831 | Comparative |
| 16 | 1.95 | 200 | 2 | 847 | Comparative |

Example 5

The same evaluation was carried out except that that in Example 4, the formulas of the fixer and fixer replenisher were the same as these of Example 3. Table 5 shows the results.

TABLE 5

| No. | Polyalkylene-oxide polyethylene glycol 4000 (g/l) | Compound Represented by General Formula (1) D-mannitol (g/l) | D-sorbitol (g/l) | Compound Represented by General Formula (2) (g/l) Sodium 1-octane-sulfonate | Sodium hexane-sulfonate | Fixer Replen-isher Rate (ml/m$^2$) | Auto-matic pro-cessor No. | Stained film Number | Note |
|---|---|---|---|---|---|---|---|---|---|
| 1 | 0 | 0 | 0 | 0 | 0 | 280 | 1 | 18035 | Comp. |
| 2 | 0 | 0 | 0 | 0 | 0 | 260 | 1 | 18020 | Inv. |
| 3 | 0 | 0 | 0 | 0 | 0 | 200 | 1 | 18012 | Inv. |
| 4 | 0 | 7 | 0 | 0 | 0 | 200 | 1 | 19091 | Inv. |
| 5 | 0 | 15 | 0 | 0 | 0 | 200 | 1 | over 20000 | Inv. |
| 6 | 0 | 0 | 7 | 0 | 0 | 200 | 1 | 19131 | Inv. |
| 7 | 0 | 0 | 15 | 0 | 0 | 200 | 1 | over 20000 | Inv. |
| 8 | 0 | 0 | 0 | 2 | 0 | 200 | 1 | 19817 | Inv. |
| 9 | 0 | 0 | 0 | 4 | 0 | 200 | 1 | over 20000 | Inv. |
| 10 | 0 | 0 | 0 | 0 | 2 | 200 | 1 | 19789 | Inv. |
| 11 | 0 | 0 | 0 | 0 | 4 | 200 | 1 | over 20000 | Inv. |
| 12 | 0 | 7 | 7 | 0 | 0 | 200 | 1 | over 20000 | Inv. |
| 13 | 0 | 0 | 0 | 2 | 2 | 200 | 1 | over 20000 | Inv. |
| 14 | 1.5 | 0 | 0 | 0 | 0 | 200 | 1 | 18082 | Inv. |
| 15 | 1.5 | 7 | 7 | 1 | 1 | 200 | 1 | over 20000 | Inv. |
| 16 | 0 | 0 | 0 | 0 | 0 | 280 | 2 | 16259 | Comp. |
| 17 | 0 | 0 | 0 | 0 | 0 | 260 | 2 | 1805 | Comp. |
| 18 | 0 | 0 | 0 | 0 | 0 | 200 | 2 | 732 | Comp. |
| 19 | 0 | 7 | 0 | 0 | 0 | 200 | 2 | 1000 | Comp. |
| 20 | 0 | 0 | 7 | 0 | 0 | 200 | 2 | 1125 | Comp. |
| 21 | 0 | 0 | 0 | 2 | 0 | 200 | 2 | 1340 | Comp. |
| 22 | 0 | 0 | 0 | 0 | 2 | 200 | 2 | 1274 | Comp. |
| 23 | 1.5 | 0 | 0 | 0 | 0 | 200 | 2 | 1091 | Comp. |

Inv.: Present Invention Comp.: Comparative

Example 6

Samples of a light-sensitive material comprising a compound represented by the general formula (T) were prepared. (Preparation of Samples Comprising Compounds Represented by General Formula (T))

Employing a double-jet mixing method, was prepared monodispersed cubic chlorobromide grains having an average grain diameter of 0.15 $\mu$m, which was composed of 98 mole percent of silver chloride and 2 mole percent of silver bromide. At the mixing, $7\times10^{-5}$ mole of $K_3Rh(H_2O)Br_5$ per mole of silver was added. Furthermore, prior to the salt-removing process by an ordinary method, in which water-soluble salts were removed, 0.6 g of 4-hydroxy-6-methyl-1,3,3a,7-tetrazaindene (TAI) per mole of silver was added (otherwise indicated, amount is per mole of silver.).

The emulsion was heated to 60° C. and was added with 60 mg of TAI and 0.75 mg of sodium thiosulfate. Furthermore, the resulting emulsion was added with TAI 60 minutes after the addition of TAI and chilled to set.

A coating liquid was then prepared so that the added amounts of additives were adjusted to these described below.

| | |
|---|---|
| (Emulsion Coating Liquid) | |
| Gelatin 10% solution | 5.26 ml/m$^2$ |
| NaOH 0.5N solution | 4.39 ml/m$^2$ |
| Compound A | 6.53 mg/m$^2$ |
| Compound represented by general formula (T) (described in Table 6) | 40.0 mg/m$^2$ |
| Kiraya saponin | 107 mg/m$^2$ |
| Compound B | 18.5 mg/m$^2$ |
| Compound C | 9.8 mg/m$^2$ |
| Gelatin latex | 480 mg/m$^2$ |
| Sodium polystyrenesulfonate | 52.2 mg/m$^2$ |
| (Preparation of Lower Protective Layer Liquid) | |
| Gelatin | 0.5 g/m$^2$ |
| Compound D | 62.0 mg/m$^2$ |
| Citric acid | 4.1 mg/m$^2$ |
| Formalin | 1.7 mg/m$^2$ |
| Sodium polystyrenesulfonate | 11.0 mg/m$^2$ |
| (Upper Protective layer) | |
| Gelatin | 0.3 g/m$^2$ |
| Compound E | 18.0 mg/m$^2$ |
| Compound D | 48.4 mg/m$^2$ |
| Compound F | 105.0 mg/m$^2$ |

-continued

| | |
|---|---|
| Compound G | 1.25 mg/m$^2$ |
| Amorphous silica (average particle diameter of 1.63 micron) | 15.0 mg/m$^2$ |
| Amorphous silica (average particle diameter of 3.5 micron) | 21.0 mg/m$^2$ |
| Citric acid | 4.5 mg/m$^2$ |
| Sodium polystyrenesulfonate | 11.0 mg/m$^2$ |
| Compound P | 72.0 mg/m$^2$ |
| Compound Q | 43.0 mg/m$^2$ |
| (Backing Coating Liquid) | |
| Compound H | 170 mg/m$^2$ |
| Compound D | 30 mg/m$^2$ |
| Compound I | 45 mg/m$^2$ |
| Compound J | 10 mg/m$^2$ |
| Kiraya saponin | 111 mg/m$^2$ |
| Compound K | 200 mg/m$^2$ |
| Colloidal silica | 200 mg/m$^2$ |
| Compound L | 35 mg/m$^2$ |
| Compound M | 31 mg/m$^2$ |
| Compound N | 3.1 mg/m$^2$ |
| Polymethylmethacrylic acid polymer (average particle diameter of 5.6 micron) | 28.9 mg/m$^2$ |
| Glyoxal | 10.1 mg/m$^2$ |
| Citric acid | 9.3 mg/m$^2$ |
| Sodium polystyrenesulfonate | 71.1 mg/m$^2$ |
| Followings were added using in-line. | |
| Compound O | 81 mg/m$^2$ |
| Compound P | 88.2 mg/m$^2$ |
| Calcium acetate | 3.0 mg/m$^2$ |
| Compound Q | 43.0 mg/m$^2$ |

Compound A

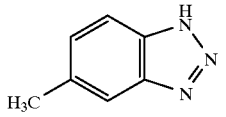

Compound B

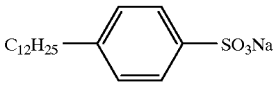

Compound C

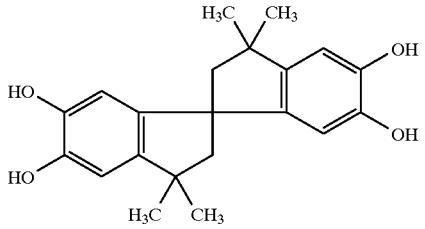

Compound D

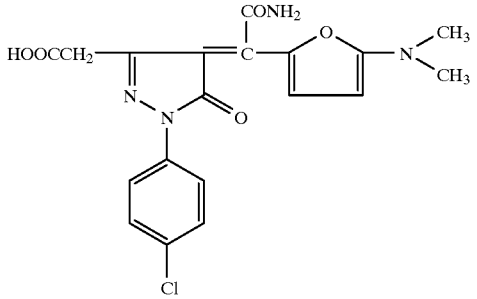

Compound E

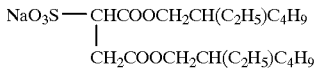

-continued
Compound F
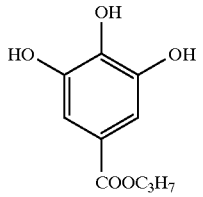
Compound G
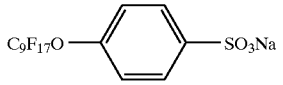
Compound H
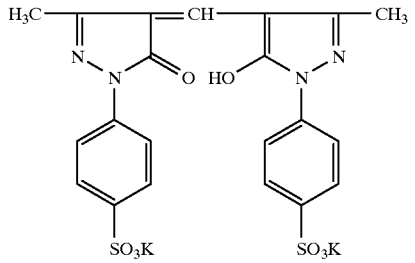
Compound I
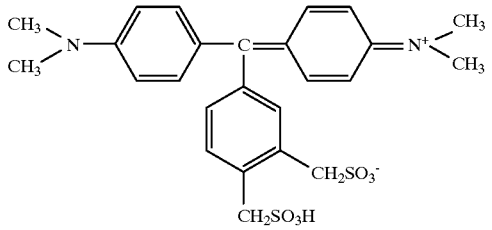
Compound J
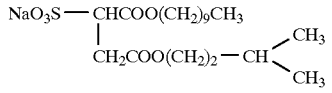
Compound K
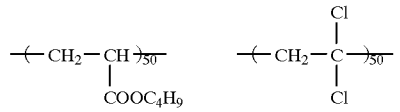
Compound L
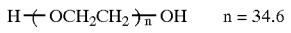
Compound M
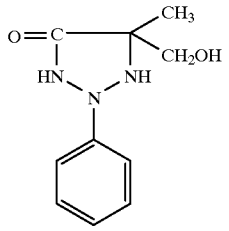
Compound N
$HOCH_2SO_3Na$
Compound O
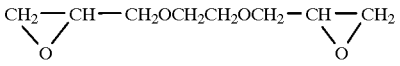

-continued

Gelatin latex

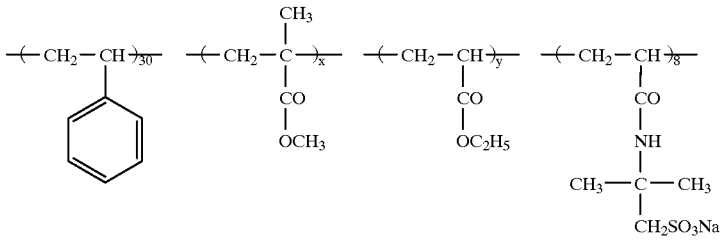

Gelatin: Latex = 5:1, X + Y = 62

Compound P

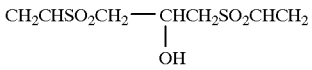

Compound Q

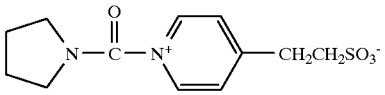

The above-mentioned coating liquid was prepared and coated. The coating was uniformly carried out so that the coated amount of silver of the emulsion layer was 2.0 g/m$^2$ and that of gelatin of the backing layer was 2.1 g/m$^2$.

Processing solutions having compositions described below were employed.

| (Developer Composition) | |
|---|---|
| Diethylenetriaminetetraacetic acid pentasodium salt | 1.0 g |
| Sodium sulfite | 42.5 g |
| Potassium sulfite | 17.5 g |
| Potassium carbonate | 55.0 g |
| Hydroquinone | 20.0 g |
| 1-Phenyl-5-mercaptotetrazole | 0.03 g |
| 4-Methyl-4-hydroxymethyl-1-phenyl-3-pyrazolidone | 0.85 g |
| Potassium bromide | 4.0 g |
| Benzotriazole | 0.21 g |
| Boric acid | 8.0 g |
| Diethylene glycol | 40.0 g |
| 8-Mercaptoadenine | 0.07 g |

Add water and potassium hydroxide to make 1 liter and adjust the pH to 10.4.

(Composition of Fixer)

| | |
|---|---|
| Ammonium thiosulfate (70% aqueous solution) | 200 ml |
| Sodium sulfite | 22 g |
| Boric acid | 9.8 g |
| Sodium acetate trihydrate | 34 g |
| Acetic acid (90% aqueous solution) | 14.5 g |
| Tartaric acid | 3.0 g |
| Aluminum sulfate (27% aqueous solution) | 25 ml |

The pH of an employed solution was adjusted to 4.9.

Exposure was carried out employing P-627 manufactured by Dainippon Screen Co. In regard to processing, the line speed was widely changed so that the total processing time is shown in Tables 6, 7 and 8. A rack-modified GR-680 manufactured by Konica Corp. was employed as an automatic processor.

The schematic structure is that as shown in the above-mentioned FIG. 4 (Automatic Processor (1)).

Figure 3:
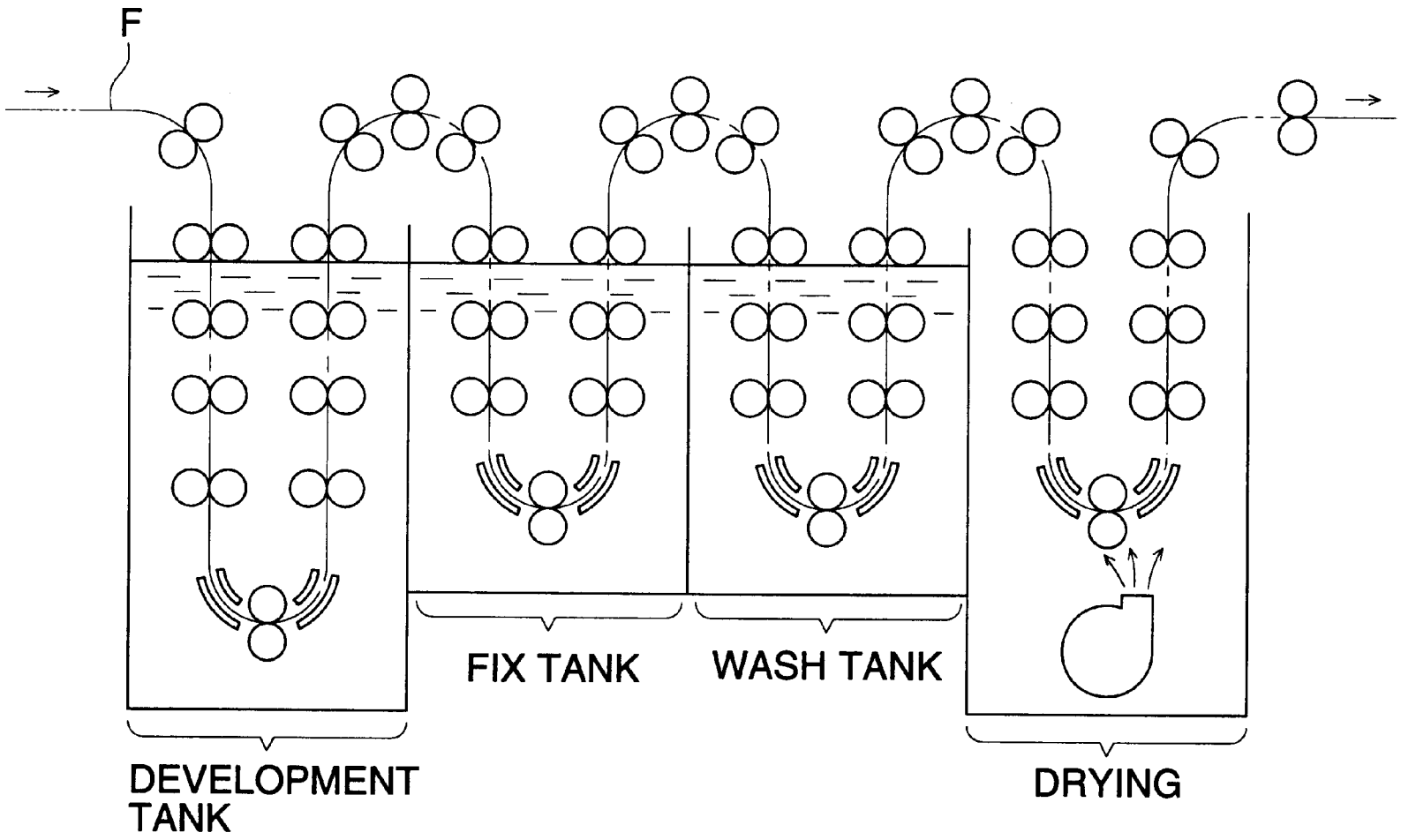
FIG. 3 shows a schematic structure of an automatic processor having a different mechanism from that of the automatic processor according to the present invention.

For comparison, a conventional automatic processor was employed. The schematic structure is shown in FIG. 3 (Automatic Processor (2)).

Processing conditions described below were employed for both.

| | | | | |
|---|---|---|---|---|
| Development | 35° C. | 15" | 30" | 32 cc/m$^2$ |
| Fix | 35° C. | 10" | 20" | 32 cc/m$^2$ |
| Wash | 17° C. | 8" | 16" | 300 cc/m$^2$ |
| Drying | 50° C. | 12" | 24" | |
| Total processing time | | 45" | 90" | |

(Further, in the case of the total processing time of 90", as mentioned above, the development time and drying time were set at 30" and 24", respectively.)

(Evaluation on Stain)

Two hundred of unexposed samples having a full size of 508 mm×610 mm prepared by coating as mentioned above were successively processed. After 24 hours, 10 sheets were again processed successively. At the time, the total number of stains having a size of 0.5 mm or more transferred onto the 10 sheets of film were counted. The number of stains per sheet is shown in the table.

(Evaluation on Residual Dye Stain)

Five unexposed films which had been processed were stacked and the residual dye stain of them was measured by a dot meter (X-Rite) as a value of fog. The value per sheet are tabulated in Table 1.

(Evaluation on Fixability)

Each of ten films which had been processed was visually inspected. The number of full size films which are not sufficiently fixed is tabulated in Table 6.

TABLE 6

| Sample No. | Compound Represented by General Formula (2) | Automatic Processor | Total Processing Time | Number of Stains Number/Full size | Residual Dye Stain | Fix-ability | Note |
|---|---|---|---|---|---|---|---|
| 1 | none | (1) | 90" | 15 | 0.035 | 2 | Comp. |
| 2 | none | (1) | 45" | 17 | 0.038 | 3 | Comp. |
| 3 | none | (2) | 90" | 22 | 0.042 | 8 | Comp. |
| 4 | none | (2) | 45" | 30 | 0.046 | 10 | Comp. |
| 5 | 2-2 | (1) | 90" | 1 | 0.025 | 0 | Inv. |
| 6 | 2-2 | (1) | 45" | 1 | 0.026 | 0 | Inv. |
| 7 | 2-2 | (2) | 90" | 14 | 0.040 | 2 | Comp. |
| 8 | 2-2 | (2) | 45" | 17 | 0.042 | 2 | Comp. |
| 9 | 2-7 | (1) | 90" | 0 | 0.024 | 0 | Inv. |
| 10 | 2-7 | (1) | 45" | 0 | 0.026 | 0 | Inv. |
| 11 | 2-7 | (2) | 90" | 13 | 0.039 | 2 | Comp. |
| 12 | 2-7 | (2) | 45" | 14 | 0.041 | 2 | Comp. |
| 13 | 2-12 | (1) | 90" | 2 | 0.027 | 0 | Inv. |
| 14 | 2-12 | (1) | 45" | 2 | 0.029 | 0 | Inv. |
| 15 | 2-12 | (2) | 90" | 15 | 0.042 | 2 | Comp. |
| 16 | 2-12 | (2) | 45" | 18 | 0.043 | 3 | Comp. |

Inv.: Present Invention
Comp.: Comparative

As clearly seen in Table 6, the embodiments of the present invention are superior to comparatives in terms of the stain, residual dye stain and fixability.

Example 7

(Preparation of Samples of Light-sensitive Materials for Printing in Bright Room)

For the preparation of samples of light-sensitive materials for printing in a bright room, there was employed the silver chlorobromide emulsion comprising 98 mole percent of silver chloride and 2 mole percent of silver bromide, and $10^{-4}$ mole of $Ru(NO)Cl_5$ per mole of silver inside the grain having a degree of monodispersion of 8.8 percent and an average grain diameter of 0.13 $\mu$m. On the front side of the support having on the back side subjected to antistatic and antihalation treatment, there were successively coated a high-sensitive emulsion layer, a low-sensitive emulsion layer, an emulsion protective lower layer and an emulsion protective upper layer.

With the use of 8.2 mg of sodium thiosulfate, 2 mg of KCNS, 15.4 mg of chloroauric acid and 5 mg of diphenylpentachlorophenyl selenide, the high-sensitive emulsion underwent gold-sulfur-selenium sensitization at 70° C. for 48 minutes. The low-sensitive emulsion having a volume average grain diameter of 0.08$\mu$ underwent gold-sulfur-selenium sensitization at 55° C. for 44 minutes in the same way as above and employed for the low-sensitive emulsion layer. The difference in sensitivity between the high-sensitive emulsion and the low-sensitive emulsion was 26 percent.

The coated amounts for each of the high-sensitive emulsion layer and the low-sensitive emulsion layer were adjusted as follows; 1 g/m$^2$ of gelatin, 0.5 g/m$^2$ of poly (methylmethacrylate$_{30}$-ethylacrylate$_{40}$-butylacrylate$_{28}$-acrylic acid$_2$: figures of suffix represent composition ratio by weight.) copolymer latex, 1.5 g/m$^2$ of silver.

To each of the upper emulsion layer and the lower emulsion layer, as the contrast-increasing agent, $1\times10^{-3}$ mole of the hydrazine derivative per mole of silver as described in Table 2 was added and to the low-sensitive emulsion, as the contrast-increasing agent, $1\times10^{-3}$ mole of the compound R shown below and $1\times10^{-3}$ mole of the phosphonium salt compound S were added. Furthermore, to the upper and lower emulsion layers, there were added, per m$^2$, 0.02 g of sodium nonylphenoxydocosaethyleneoxidesulfonate as a surface active agent, 0.02 g of 1-(p-carboxyphenyl)-5-mercaptotetrazole, 0.001 g of benzotriazole, 0.001 g of 1-butanesulfonic acid-2,3-dithiacyclohane and 0.003 g of adenine as antifoggants and 0.06 g of polystyrenesulfonic acid having a molecular weight of 680,000, 0.04 g of a styrene-maleic acid copolymer and 0.05 g of polyvinylpyrrolidone as thickening agents.

Coating was carried out so that the coated amounts of the emulsion protective upper layer and the lower layer were 0.4 g./m$^2$ and 0.5 g/m$^2$, respectively and the coated amount of latex for each of both layers was 0.2 g/m$^2$ and the upper protective layer comprised 0.03 g/m$^2$ of a matting agent composed of silicone dioxide. Further, to each of the upper and lower protective layers, $1.3\times10^{-3}$ mole per m$^2$ of the compound D and a water-soluble dye were added. The hydrophilic colloid layer was hardened by the addition of 80 mg/m$^2$ of the compound P and 46 mg/m$^2$ of the compound Q.

Hydrazine derivative: the number of specific example represented by the general formula (1) herein is shown. As the phosphonium, the compound S described below was employed.

Compound R

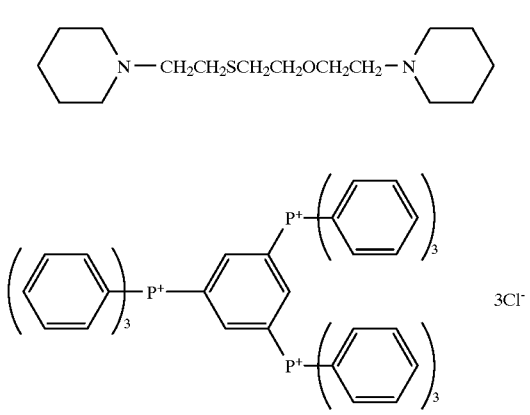

(Composition of Employed Developer)

| | |
|---|---|
| 1-Phenyl-3-pyrazolidone | 1.5 g |
| Hydroquinone | 30 g |
| Erythorbic acid | 25 g |
| 5-Nitroindazole | 0.250 g |
| 5-Methylbenzotriazole | 0.06 g |
| Potassium bromide | 3.4 g |
| Sodium sulfite | 50 g |
| Potassium hydroxide | 30 g |
| Boric acid | 12 g |
| Water to make | 1 liter |
| pH | adjusted to 10.20 |
| Ammonium thiosulfate (72.5% by W/V) solution | 240 ml |
| Sodium sulfite | 17 g |
| Sodium acetate trihydrate | 6.5 g |

-continued

Compound R

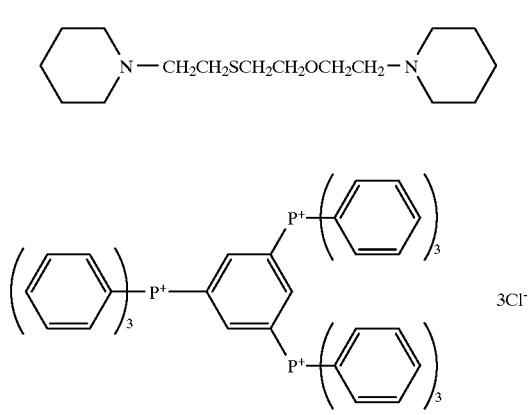

(Composition of Employed Developer)

| | |
|---|---|
| Boric acid | 6.0 g |
| Sodium citrate dihydrate | 2.0 g |
| Acetic acid (90% by W/V aqueous solution) | 13.6 ml |
| Sulfuric acid (50% by W/V aqueous solution) | 4.7 g |
| Aluminum sulfate (8.1% by W/V aqueous solution in terms of $Al_2O_3$ conversion | 26.5 g |
| Water to make | 1 liter |
| pH | adjusted to 5.6 |

(Evaluation)

Evaluation was carried out in the same way as for Example 6

Table 7 shows the above-mentioned results.

TABLE 7

| Sample No. | Hydrazine Compound | Automatic Processor | Total Processing Time | Number of Stains Number/Full size | Residual Dye Stain | Fix-ability | Note |
|---|---|---|---|---|---|---|---|
| 1 | none | (1) | 90" | 18 | 0.036 | 3 | Comp. |
| 2 | none | (1) | 45" | 20 | 0.040 | 4 | Comp. |
| 3 | none | (2) | 90" | 25 | 0.046 | 9 | Comp. |
| 4 | none | (2) | 45" | 36 | 0.049 | 10 | Comp. |
| 5 | 1-38 | (1) | 90" | 0 | 0.026 | 0 | Inv. |
| 6 | 1-38 | (1) | 45" | 1 | 0.027 | 0 | Inv. |
| 7 | 1-38 | (2) | 90" | 15 | 0.035 | 2 | Comp. |
| 8 | 1-38 | (2) | 45" | 16 | 0.036 | 2 | Comp. |
| 9 | 1-41 | (1) | 90" | 0 | 0.023 | 0 | Inv. |
| 10 | 1-41 | (1) | 45" | 0 | 0.024 | 0 | Inv. |
| 11 | 1-41 | (2) | 90" | 13 | 0.032 | 2 | Comp. |
| 12 | 1-41 | (2) | 45" | 13 | 0.033 | 2 | Comp. |
| 13 | 1-57 | (1) | 90" | 0 | 0.021 | 0 | Inv. |
| 14 | 1-57 | (1) | 45" | 0 | 0.022 | 0 | Inv. |
| 15 | 1-57 | (2) | 90" | 16 | 0.033 | 2 | Comp. |
| 16 | 1-57 | (2) | 45" | 18 | 0.034 | 3 | Comp. |
| 17 | 1-42 | (1) | 90" | 2 | 0.028 | 0 | Inv. |
| 18 | 1-42 | (1) | 45" | 2 | 0.029 | 1 | Inv. |
| 19 | 1-42 | (2) | 90" | 18 | 0.036 | 3 | Comp. |
| 20 | 1-42 | (2) | 45" | 19 | 0.037 | 3 | Comp. |

Inv.: Present Invention
Comp.: Comparative

As clearly seen in Table 7, the embodiments of the present invention are superior to comparatives in terms of stain, residual dye stain and fixability.

Furthermore, according to the preparation method of the light-sensitive material for image setter (for light sources such as Ar, He-Ne, red LD, infrared LD, etc.) employing hydrazine as disclosed in Japanese Patent Publication Open to Public Inspection No. 8-297340, experiments were carried out in which the hydrazine compound of the present invention was replaced with the above-mentioned hydrazine. As a result, good results were obtained in the same way as for Example 7.

Furthermore, employing the solid processing agents as described in Japanese Patent Publication Open to Public Inspection No. 8-278608, light-sensitive materials for bright room shown in Examples 1 and 2, and the above-mentioned light-sensitive material for the image setter were processed. As a result, the embodiments of the present invention were superior to these in terms of stain, residual dye stain and fixability.

The present invention can provide a processing method of a contrast-increased silver halide photographic light-sensitive material which results in a small amount of the supply of a processing solution and solution wastes; is superior in fixability; causes no formation of stain on a roller and needs a small amount of wash water.

We claim:

1. A processing method of a silver halide photographic light-sensitive material, wherein an automatic processor is employed which is constituted in such a manner that a section is provided which conveys a silver halide photographic light-sensitive material in vertical direction; a plurality of arranged rollers are provided so as to be in contact with or adjacent to said silver halide photographic light-sensitive material; a structure is that by employing a roller having a processing solution-containing function and/or providing a solution-collecting vessel, at a lower position of the roller, into which a part of the roller is immersed, the processing solution is supplied by the rotation of the roller to said silver halide photographic light-sensitive material; there is provided at least one selected from the means to supply the processing solution to the roller at the upper position, the solution-collecting vessel and the silver halide photographic light-sensitive material, and the supplied processing solution is supplied to the roller at the lower position and/or the solution-collecting vessel through gravity flow and/or overflow, and processing is carried out employing a fixer having a salt concentration of 0.8 to 1.9 mole/l at a fixer replenisher rate of not more than 260 ml/m$^2$.

2. A processing method of claim 1 wherein the fixer comprises at least one compound selected from polyalkylene oxides, compounds represented by the following general formula (1) and compounds represented by the following general formula (2), General formula (1)

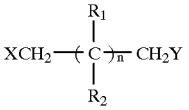

wherein X and Y each independently represents a halogen atom, a hydroxyl group, a sulfonic acid group, a carboxyl group, and $R_1$ and $R_2$ each independently represents a hydrogen atom or a hydroxyl group and n represents an integer of 3 to 10

$$CH_3(CH_2)_n—(O)_m—SO_3M$$ General formula (2)

wherein n represents an integer of 4 to 15; m represents 0 or 1 and M represents an alkali metal.

3. A processing method of a silver halide photographic light-sensitive material of claim 1, wherein said fixer comprises at least one compound selected from tartaric acids or gluconic acid.

4. A processing method of a silver halide photographic light-sensitive material of claim 1, wherein said fixer comprises no boric acid.

5. A processing method of a silver halide photographic light-sensitive material of claim 1, wherein total processing time is not longer than 50 seconds.

6. A processing method of a silver halide photographic light-sensitive material of claim 1, wherein the light-sensitive material to be processed comprises at least one compound selected from hydrazine derivatives or quaternary onium salt compounds.

7. The processing method of a silver halide photographic light-sensitive material of claim 1, wherein the silver halide photographic light-sensitive material-comprises a hydrazine derivative in the emulsion layer or another hydrophilic colloid layer.

8. The processing method of a silver halide photographic light-sensitive material of claim 1, wherein the silver halide photographic light-sensitive material comprises a tetrazolium compound in the emulsion layer or another hydrophilic colloid layer.

* * * * *